US011148251B2

(12) United States Patent
Muto et al.

(10) Patent No.: US 11,148,251 B2
(45) Date of Patent: Oct. 19, 2021

(54) GRINDER

(71) Applicant: MAKITA CORPORATION, Anjo (JP)

(72) Inventors: Hideharu Muto, Anjo (JP); Junya Ishikawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 508 days.

(21) Appl. No.: 16/000,010

(22) Filed: Jun. 5, 2018

(65) Prior Publication Data

US 2018/0361536 A1 Dec. 20, 2018

(30) Foreign Application Priority Data

Jun. 20, 2017 (JP) ..... JP2017-120857

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/052; B24B 55/05; B24B 55/04; B24B 23/02; B24B 23/022; B24B 23/028; B23Q 11/08; B23Q 11/0883
USPC ..... 451/451, 454, 359, 357, 457
See application file for complete search history.

(56) References Cited

U.S. PATENT DOCUMENTS 8,500,521 B2 * 8/2013 Boeck ..... B24B 55/052 451/451
8,550,885 B2 * 10/2013 Tanaka ..... B24B 55/052 451/451
9,102,032 B2 * 8/2015 Nakamura ..... B24B 55/05
9,475,172 B2 * 10/2016 Cooksey ..... B24B 23/028
2010/0210195 A1 8/2010 Numata et al.
2010/0304648 A1 12/2010 Boeck et al.
2011/0151757 A1 6/2011 Tanaka
(Continued)

FOREIGN PATENT DOCUMENTS

CN 102126180 A 7/2011
CN 103158071 A 6/2013
(Continued)

OTHER PUBLICATIONS

Jan. 6, 2021 Office Action issued in Chinese Patent Application No. 2018105222891.
(Continued)

*Primary Examiner* — Orlando E Aviles
*Assistant Examiner* — Robert F Neibaur
(74) *Attorney, Agent, or Firm* — Oliff PLC

(57) ABSTRACT

A grinder may include a motor; a spindle to which a grinding wheel is attached; bevel gears configured to transmit rotation of the motor to the spindle; a motor housing which houses the motor; a gear housing attached to a front side of the motor housing and housing the bevel gears; a spindle case attached to a lower side of the gear housing and rotatably supporting the spindle; a wheel cover attached to the spindle case and covering an outside of at least a part of the grinding wheel; and a stopper configured to prohibit removal of the wheel cover, wherein the stopper may be fastened together with the spindle case by a screw which fastens the spindle case to the gear housing.

3 Claims, 27 Drawing Sheets

(56) References Cited

U.S. PATENT DOCUMENTS

| | | | | |
|---|---|---|---|---|
| 2012/0190280 | A1 | 7/2012 | Esenwein | |
| 2012/0295524 | A1 | 11/2012 | Numata | |
| 2013/0157550 | A1 | 6/2013 | Ikuta | |
| 2017/0057075 | A1* | 3/2017 | Takeda | B25F 5/02 |
| 2017/0072533 | A1 | 3/2017 | Yoshizaki et al. | |
| 2017/0072534 | A1 | 3/2017 | Nakamura et al. | |

FOREIGN PATENT DOCUMENTS

| | | | |
|---|---|---|---|
| CN | 106514468 | A | 3/2017 |
| CN | 106514496 | A | 3/2017 |
| JP | 2011-125983 | A | 6/2011 |
| JP | 2012-240127 | A | 12/2012 |
| JP | 2013-501635 | A | 1/2013 |
| JP | 5259614 | B2 | 8/2013 |
| JP | 5959421 | B2 | 8/2016 |
| JP | 2017-052059 | A | 3/2017 |
| KR | 100882805 | B1 | 2/2009 |

OTHER PUBLICATIONS

Apr. 6, 2021 Office Action issued in Japanese Patent Application No. 20187-120857.

* cited by examiner

GRINDER

CROSS-REFERENCE

This application claims priority to Japanese patent application No. 2017-120857, filed on Jun. 20, 2017, the entire contents of which are incorporated herein by reference.

TECHNICAL FIELD

The technique disclosed herein relates to a grinder.

BACKGROUND

Japanese Patent Application Publication No. 2011-125983 describes a grinder that includes a motor, a spindle to which a grinding wheel is attached, bevel gears that transmit rotation of the motor to the spindle, a motor housing that houses the motor, a gear housing attached to a front side of the motor housing and housing the bevel gears, a spindle case attached to a lower side of the gear housing and rotatably supporting the spindle, and a wheel cover attached to the spindle case and covering an outside of at least a part of the grinding wheel.

SUMMARY

Upon usage of the grinder, the wheel cover must surely be attached for safety of users. However, if the wheel cover is given a configuration by which a user can freely remove it, the grinder might be used in a state where the wheel cover is removed. A technique that enables to prevent removal of a wheel cover by a user with a simple configuration is being demanded.

A grinder disclosed herein may comprise a motor; a spindle to which a grinding wheel is attached; bevel gears configured to transmit rotation of the motor to the spindle; a motor housing which houses the motor; a gear housing attached to a front side of the motor housing and housing the bevel gears; a spindle case attached to a lower side of the gear housing and rotatably supporting the spindle; a wheel cover attached to the spindle case and covering an outside of at least a part of the grinding wheel; and a stopper configured to prohibit removal of the wheel cover. The stopper may be fastened together with the spindle case by a screw which fastens the spindle case to the gear housing.

Another grinder disclosed herein may comprise a motor; a spindle to which a grinding wheel is attached; a power transmission unit configured to transmit rotation of the motor to the spindle; a motor housing which houses the motor; a gear housing attached to a front side of the motor housing and housing the power transmission unit; a spindle case attached to a lower side of the gear housing and rotatably supporting the spindle; a wheel cover attached to the spindle case and covering an outside of at least a part of the grinding wheel; and a stopper configured to prohibit removal of the wheel cover. The stopper may be attached so as to protrude downward along a rotation axis of the spindle.

Yet another grinder disclosed herein may comprise a motor; a spindle to which a grinding wheel is attached; a power transmission unit configured to transmit rotation of the motor to the spindle; a motor housing which houses the motor; a gear housing attached to a front side of the motor housing and housing the power transmission unit; a spindle case attached to a lower side of the gear housing and rotatably supporting the spindle; a wheel cover attached to the spindle case and covering an outside of at least a part of the grinding wheel; and a stopper configured to prohibit removal of the wheel cover. The stopper may be fastened by a screw. A head of the screw is shielded from exterior.

According to the above configurations, removal of the wheel cover by a user can be prevented with a simple configuration.

DETAILED DESCRIPTION

Figure 1:
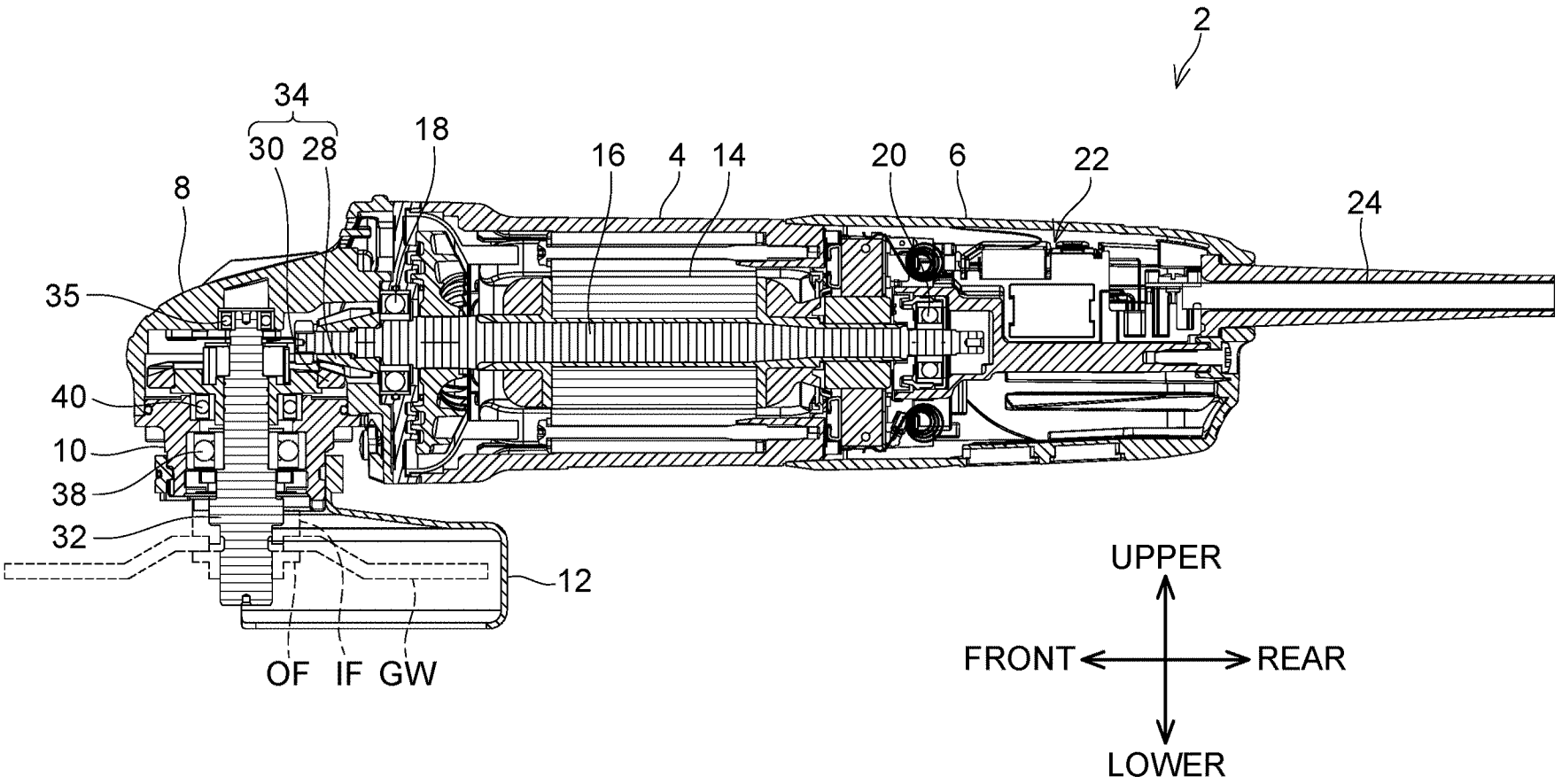
FIG. 1 is a vertical cross-sectional view of a grinder 2 of a first embodiment.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved grinders, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, the wheel cover may be rotatable around a rotation axis of the spindle relative to the spindle case and may be removable by being slid along the rotation axis of the spindle at a removable position. The stopper may prohibit the wheel cover from rotating from a normal position to the removable position.

According to the above configuration, removal of the wheel cover by a user can be prevented by the stopper prohibiting the wheel cover from rotating from the normal position to the removable position.

In one or more embodiments, the stopper may have a shape that contacts a side surface of the wheel cover when the wheel cover rotates from the normal position to the removable position. The stopper may be fastened together with the spindle case by the screw on a front side of the gear housing.

Normally, when the wheel cover is at the normal position, the wheel cover is located on a rear side. Thus, by fastening the stopper together with the spindle case by the screw on the front side in a state where the wheel cover has been attached to the spindle case and rotated from the removable position to the normal position, the wheel cover can be prohibited from rotating from the normal position to the removable position by using a simply-shaped stopper.

In one or more embodiments, the stopper may include a sleeve which surrounds a head of the screw and contacts the side surface of the wheel cover when the wheel cover rotates from the normal position to the removable position.

According to the above configuration, the wheel cover can be prohibited from rotating from the normal position to the removable position by the simply-shaped sleeve.

In one or more embodiments, a cap may be inserted into the sleeve.

According to the above configuration, since the screw fastening the stopper together with the spindle case is shielded from exterior by the sleeve and the cap, removal of the stopper by the user can be prevented.

In one or more embodiments, the stopper may include a hook which is engaged with a lower surface of the wheel cover, and contacts the side surface of the wheel cover when the wheel cover rotates from the normal position to the removal position.

According to the above configuration, the wheel cover can be prohibited from rotating from the normal position to the removable position by the hook, and further, movement of the wheel cover at the normal position along a sliding direction can also be prohibited by the hook.

In one or more embodiments, the screw fastening the stopper together with the spindle case may be a special screw.

According to the above configuration, since the special screw, which cannot be removed by regular tools on the market, is used as the screw for fastening the stopper together with the spindle case, removal of the stopper by the user can be prevented.

In one or more embodiments, the wheel cover may include a protrusion and the stopper may include an elastic piece that engages with the protrusion. When the wheel cover rotates from the removable position to the normal position, the elastic piece may be elastically deformed to allow the rotation of the wheel cover. When the wheel cover rotates from the normal position to the removable position, the elastic piece may engage with the protrusion to prohibit the rotation of the wheel cover.

According to the above configuration, the stopper allows the rotation of the wheel cover from the removable position to the normal position, while it prohibits the rotation of the wheel cover from the normal position to the removable position. In this case, the stopper can be attached to the spindle case prior to the attachment of the wheel cover, so workability for attaching the stopper can be improved.

In one or more embodiments, the elastic piece of the stopper may be disposed on a rear side of the gear housing, and the stopper may be fastened together with the spindle case by the screw on the rear side of the gear housing.

According to the above configuration, a normal rotary operation of the wheel cover can be prevented from being affected by chips adhering to the elastic piece of the stopper upon using the grinder. Further, according to the above configuration, the screw fastening the stopper together with the spindle case is shielded by the wheel cover at the normal position, so removal of the stopper by the user can be prevented.

In one or more embodiments, the screw fastening the stopper together with the spindle case may be a special screw.

According to the above configuration, since the special screw, which cannot be removed by regular tools on the market, is used as the screw for fastening the stopper together with the spindle case, removal of the stopper by the user can be prevented.

In one or more embodiments, the wheel cover may be rotatable around a rotation axis of the spindle relative to the spindle case and may be removable by being slid along the rotation axis of the spindle at a removable position. The stopper may prohibit sliding of the wheel cover at the removable position along the rotation axis of the spindle and may prohibit the wheel cover from being removed.

According to the above configuration, the stopper prohibits the wheel cover at the removable position from being slid along the rotation axis of the spindle and being removed, so removal of the wheel cover by the user can thereby be prevented.

In one or more embodiments, the wheel cover may include a protrusion and the stopper may include an elastic piece which engages with the protrusion. When the wheel cover is to be attached to the spindle case, the elastic piece may be elastically deformed to allow the sliding of the wheel cover. When the wheel cover is to be removed from the spindle case, the elastic piece may engage with the protrusion to prohibit the sliding of the wheel cover.

According to the above configuration, the stopper allows the wheel cover to slide when the wheel cover is to be attached but prohibits the sliding of the wheel cover when the wheel cover is to be removed. In this case, the stopper can be attached to the spindle case prior to the attachment of the wheel cover, so the workability for attaching the stopper can be improved.

In one or more embodiments, the elastic piece of the stopper may be disposed on a rear side of the gear housing, and the stopper may be fastened together with the spindle case by the screw on the rear side of the gear housing.

According to the above configuration, the normal rotary operation of the wheel cover can be prevented from being affected by chips adhering to the elastic piece of the stopper upon using the grinder. Further, according to the above configuration, the screw fastening the stopper together with the spindle case is shielded by the wheel cover at the normal position, so removal of the stopper by the user can be prevented.

In one or more embodiments, the screw fastening the stopper together with the spindle case may be a special screw.

According to the above configuration, since the special screw, which cannot be removed by regular tools on the market, is used as the screw for fastening the stopper together with the spindle case, removal of the stopper by the user can be prevented.

First Embodiment

As shown in FIG. 1, a grinder 2 of a first embodiment includes a motor housing 4, a rear housing 6, a gear housing 8, a spindle case 10, and a wheel cover 12.

A motor 14 is housed inside the motor housing 4. The motor 14 includes an output shaft 16 extending in a front and rear direction. The output shaft 16 is supported rotatably by the motor housing 4 via bearings 18, 20.

The rear housing 6 is attached at a rear side of the motor housing 4. A power supply circuit 22 is housed inside the rear housing 6. Power is supplied from an external power source to the power supply circuit 22 through a power cable 24. The power supply circuit 22 supplies the power to the motor 14 when a user operates a switch 26 (see FIG. 2) to ON, and stops the power supply to the motor 14 when the user operates the switch 26 to OFF. The motor 14 rotates the output shaft 16 by the power supplied from the power supply circuit 22.

Figure 2:
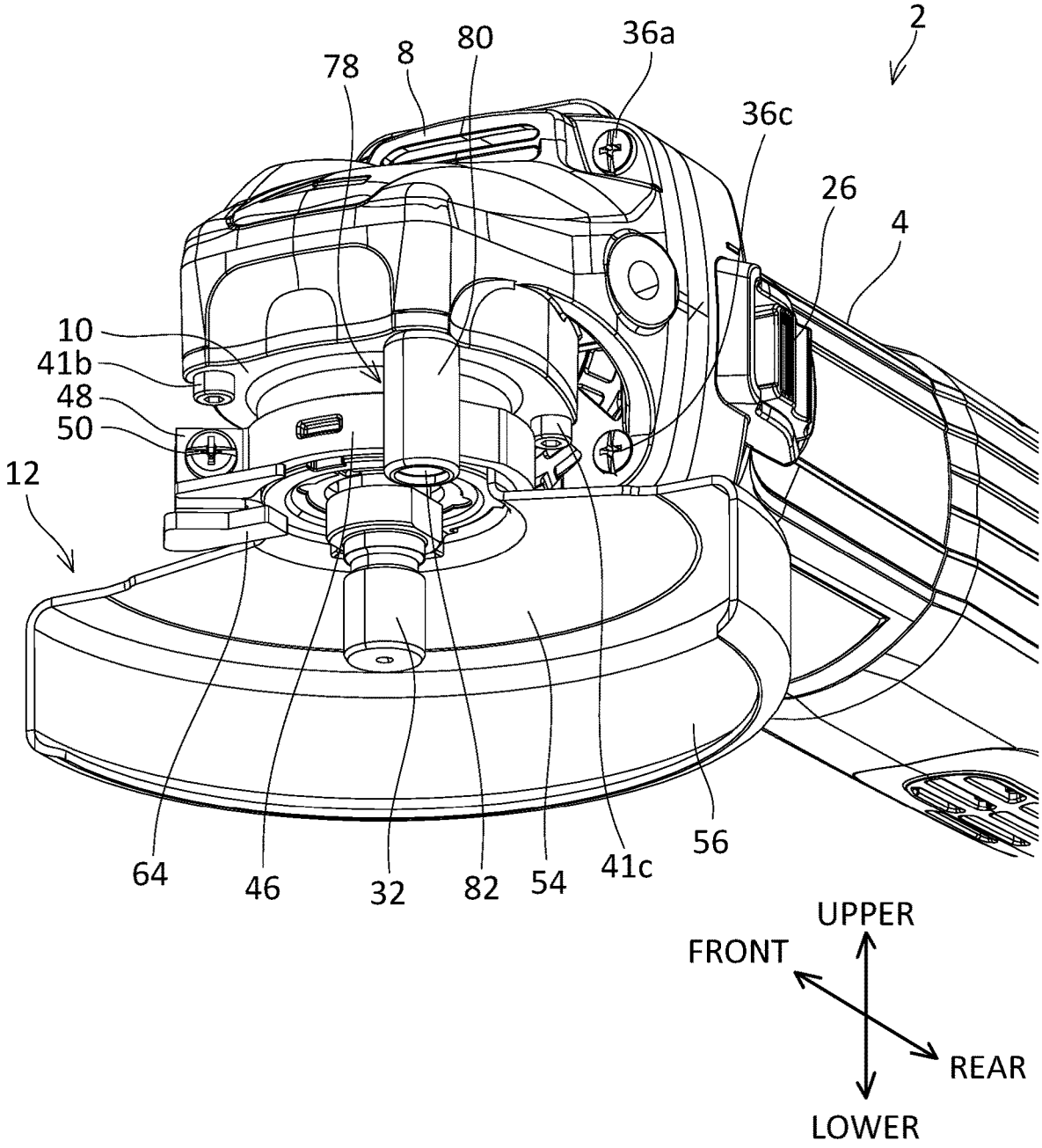
FIG. 2 is a perspective view seeing the grinder 2 of the first embodiment from a lower front left side.
Figure 8:
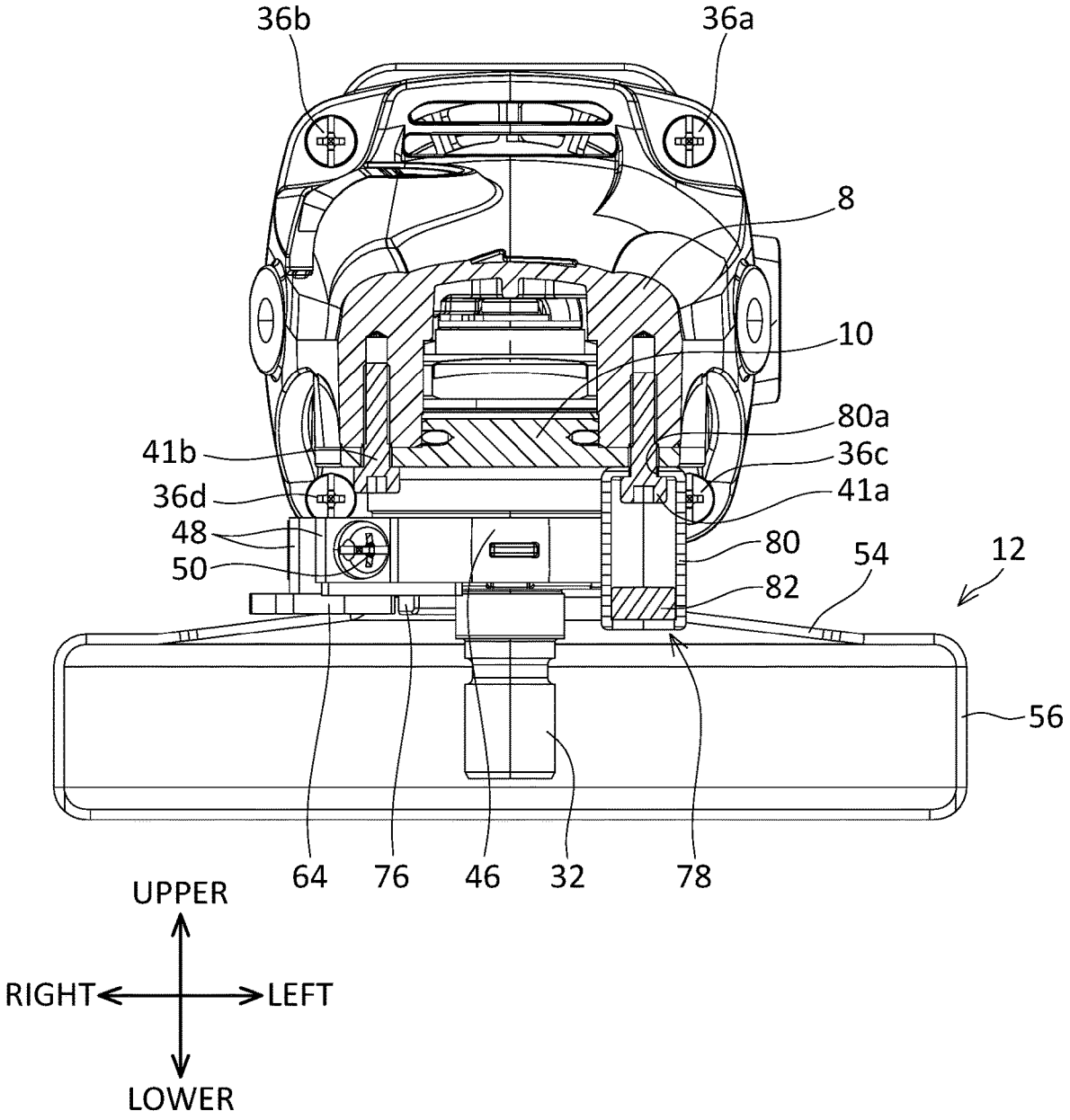
FIG. 8 is a horizontal cross-sectional view of the grinder 2 of the first embodiment at an attaching portion of the stopper 78.

The gear housing 8 is attached at a front side of the motor housing 4. A first bevel gear 28 and a second bevel gear 30 that are arranged to mesh with each other are housed inside the gear housing 8. The first bevel gear 28 is fixed to a front end portion of the output shaft 16. The second bevel gear 30 is fixed to an upper end portion of a spindle 32 extending in an up and down direction. Hereinbelow, the first bevel gear 28 and the second bevel gear 30 may collectively be termed bevel gears 34. The bevel gears 34 transmit rotation of the motor 14 to the spindle 32. The gear housing 8 retains the upper end portion of the spindle 32 via a bearing 35. As shown in FIGS. 2 and 8, the gear housing 8 is fixed to the motor housing 4 by four screws 36*a*, 36*b*, 36*c*, 36*d* extending in the front and rear direction.

Figure 4:
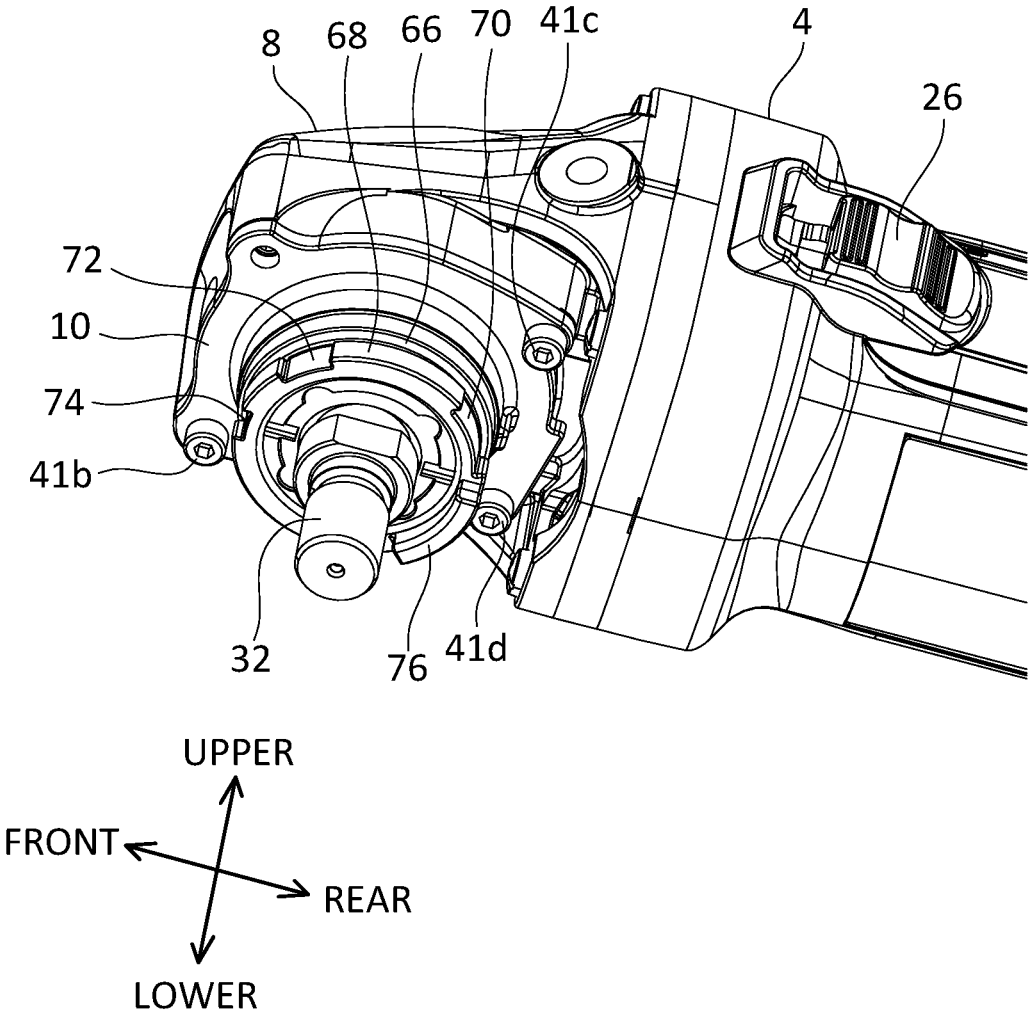
FIG. 4 is a perspective view seeing the grinder 2 of the first embodiment from the lower front left side before the wheel cover 12 and a stopper 78 are attached.

As shown in FIG. 1, the spindle case 10 is attached at a lower side of the gear housing 8. The spindle case 10 retains the spindle 32 via bearings 38, 40. The spindle 32 is capable of rotating relative to the spindle case 10 about a rotation axis along the up and down direction. A grinding wheel GW can be attached to a lower end portion of the spindle 32 via an inner flange IF and an outer flange OF. In the grinder 2, when the motor 14 rotates, the grinding wheel GW rotates about the rotation axis together with the spindle 32 to grind a workpiece. As shown in FIGS. 2, 4, and 8, the spindle case 10 is fixed to the gear housing 8 by four screws 41*a*, 41*b*, 41*c*, 41*d* extending in the up and down direction.

As shown in FIG. 1, the spindle case 10 has the wheel cover 12 attached thereto. The wheel cover 12 is given a shape which covers at least a part of the grinding wheel GW. In this embodiment, the wheel cover 12 is given a shape which covers a portion of the grinding wheel GW, which is substantially a half of the grinding wheel GW. In an example shown in FIG. 1, the wheel cover 12 is arranged at a position to cover a rear portion of the grinding wheel GW. By the wheel cover 12, chips can be prevented from flying toward the user from the grinding wheel GW upon using the grinder 2.

Figure 3:
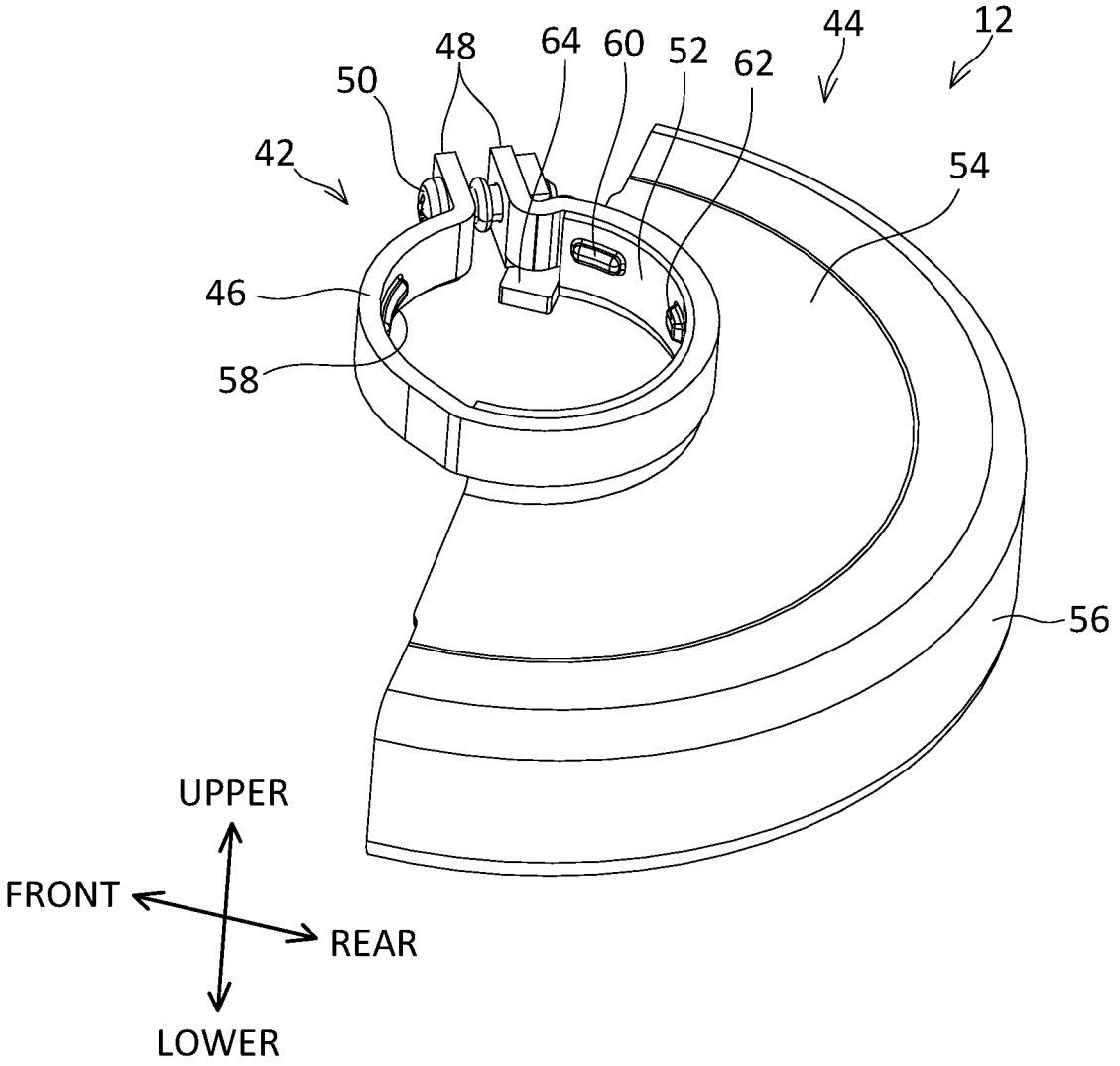
FIG. 3 is a perspective view showing an outer appearance of a wheel cover 12 of the grinder 2 of the first embodiment.

As shown in FIG. 3, the wheel cover 12 includes a band 42 and a cover 44. The band 42 includes a curved portion 46 which is a band-like flat plate curved in a cylinder shape, a pair of flat plate portions 48 extending outward from respective ends of the curved portion 46, and an adjustment screw 50 for adjusting an interval between the pair of flat plate portions 48. The cover 44 includes an inner cylinder portion 52, a truncated cone portion 54, and an outer cylinder portion 56. The inner cylinder portion 52 and the outer cylinder portion 56 are each given a cylindrical shape of which cross section is substantially semicircular. The truncated cone portion 54 is given a truncated cone shape connecting a lower end of the inner cylinder portion 52 and an upper end of the outer cylinder portion 56. The band 42 and the cover 44 are fixed to each other by welding an outer circumferential surface of the inner cylinder portion 52 to an inner circumferential surface of the curved portion 46. A rib 58 is provided on an inner circumferential surface of the band 42. Ribs 60, 62 are provided on an inner circumferential surface of the inner cylinder portion 52. The wheel cover 12 is provided with a contact piece 64. The contact piece 64 is welded to a side surface of one end of the truncated cone portion 54 and a lower surface of one of the flat plate portions 48. The contact piece 64 protrudes inward at a greater degree than the inner circumferential surface of the curved portion 46 and the inner circumferential surface of the inner cylinder portion 52.

As shown in FIG. 4, the spindle case 10 is provided with a substantially cylindrical-shaped cover-attaching portion 66 which protrudes downward along a rotation axis direction of the spindle 32 (that is, along the up and down direction). A flange 68 protruding outward is provided on an outer circumferential surface of the cover-attaching portion 66 in a vicinity of its lower end. The flange 68 is provided with notches 70, 72, 74 corresponding to the ribs 58, 60, 62 of the wheel cover 12. The wheel cover 12 can be attached to the spindle case 10 by positioning the ribs 58, 60, 62 to meet the notches 70, 72, 74 and then sliding the wheel cover 12 in an upper direction relative to the spindle case 10 such that the cover-attaching portion 66 enters to an inner side of the curved portion 46 and the inner cylinder portion 52. A position of the wheel cover 12 after having been attached to the spindle case 10 with the ribs 58, 60, 62 positioned to meet the notches 70, 72, 74 may hereinbelow be termed a removable position. The wheel cover 12 attached to the spindle case 10 can rotate about the cover-attaching portion 66. In other words, the wheel cover 12 can rotate about the rotation axis direction of the spindle 32 (that is, in the up and down direction) relative to the spindle case 10. When the wheel cover 12 is rotated relative to the spindle case 10 from the removable position, the ribs 58, 60, 62 engage with the flange 68, and the wheel cover 12 is thereby prohibited from sliding downward relative to the spindle case 10. In this case, the wheel cover 12 cannot be removed from the spindle case 10. When the wheel cover 12 is rotated relative to the spindle case 10 to the removable position, the ribs 58, 60, 62 and the notches 70, 72, 74 are positioned to meet each other, and the wheel cover 12 is thereby allowed to slide downward relative to the spindle case 10. In this case, the wheel cover 12 can be removed from the spindle case 10.

A lower surface of the cover-attaching portion 66 is provided with a protrusion 76 protruding downward. The protrusion 76 makes contact with the contact piece 64 of the wheel cover 12 and restricts an angle by which the wheel cover 12 can rotate. The wheel cover 12 attached to the spindle case 10 can rotate from the removable position to a position where the contact piece 64 makes contact with the protrusion 76. A user of the grinder 2 can fix a position of the wheel cover 12 relative to the spindle case 10 by rotating the wheel cover 12 to a desired position within its rotatable range and tightening the adjustment screw 50. Hereinbelow, the position of the wheel cover 12 relative to the spindle case 10 upon using the grinder 2 may be termed a normal position. When the adjustment screw 50 is tightened, the curved portion 46 and the inner cylinder portion 52 are pressed against the cover-attaching portion 66 and the rotation of the wheel cover 12 relative to the spindle case 10 is prohibited. When the adjustment screw 50 is loosened, the curved portion 46 and the inner cylinder portion 52 becomes no longer pressed against the cover-attaching portion 66, and the rotation of the wheel cover 12 relative to the spindle case 10 is thereby allowed.

Figure 5:
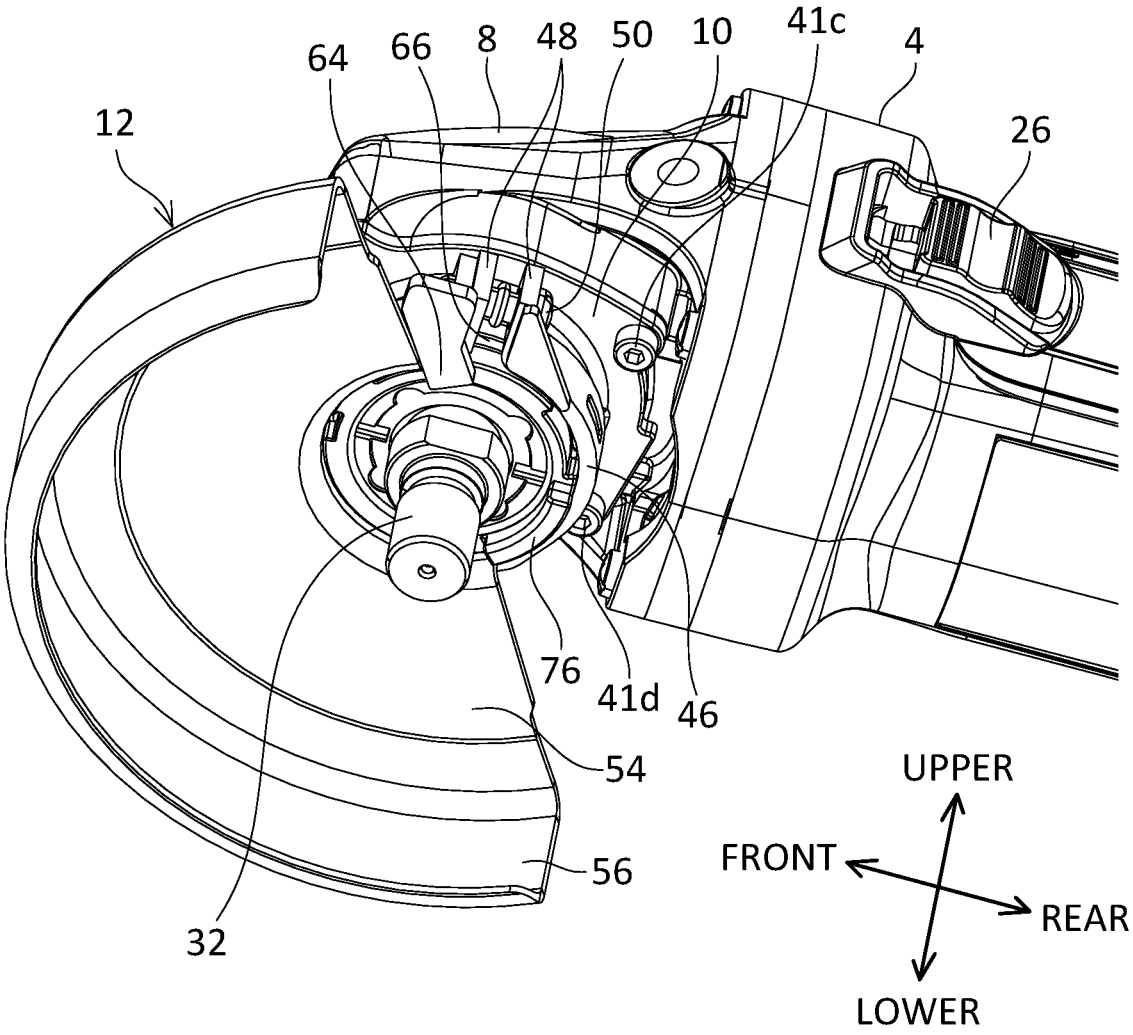
FIG. 5 is a perspective view seeing the grinder 2 of the first embodiment from the lower front left side after the wheel cover 12 has been attached and when the wheel cover 12 is at a removable position.
Figure 6:
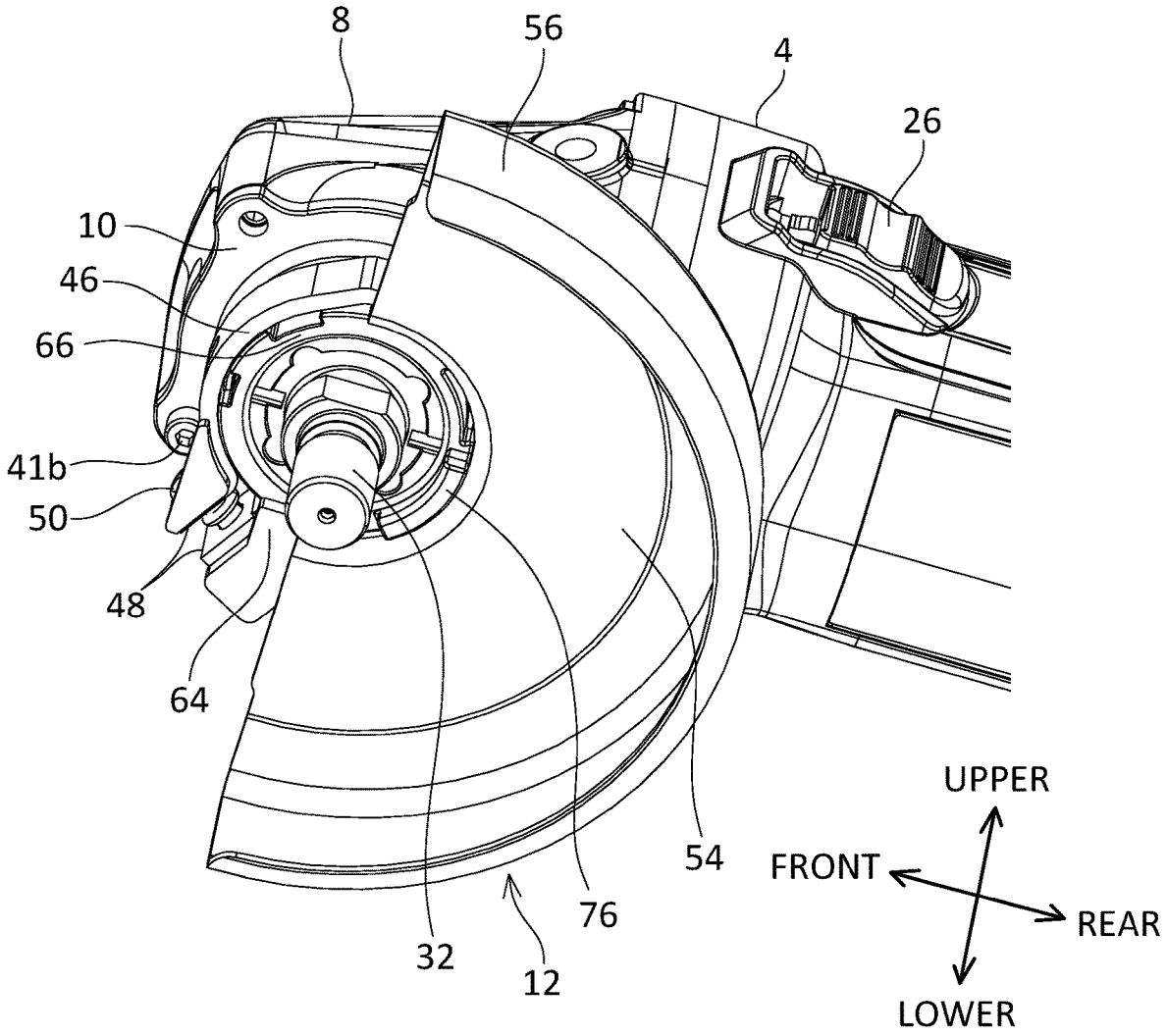
FIG. 6 is a perspective view seeing the grinder 2 of the first embodiment from the lower front left side after the wheel cover 12 has been attached and when the wheel cover 12 is at a normal position.
Figure 7:
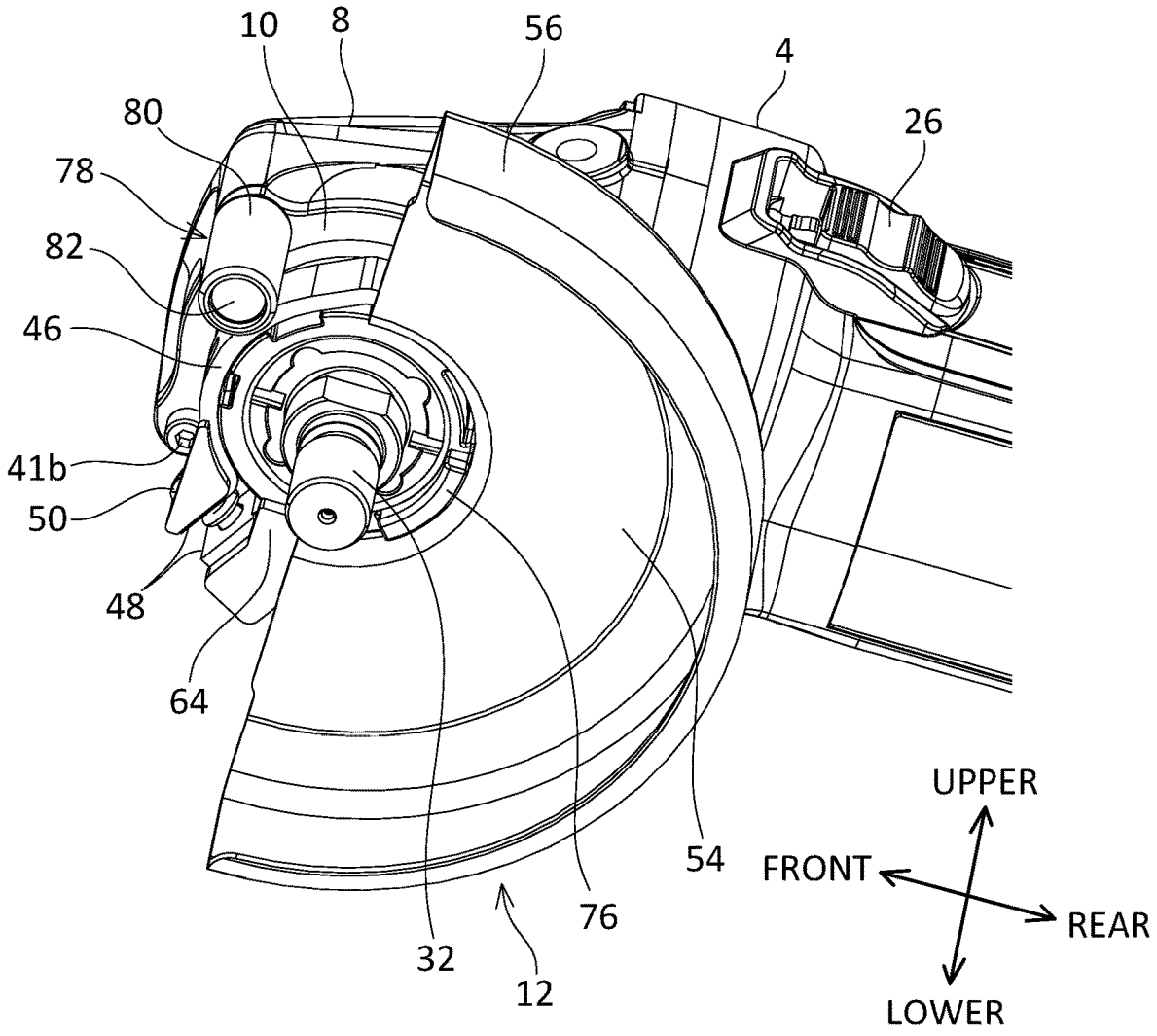
FIG. 7 is a perspective view seeing the grinder 2 of the first embodiment from the lower front left side after the wheel cover 12 has been attached and the stopper 78 has further been attached.

As shown in FIG. 4, in the grinder 2 of the present embodiment, the attachment of the wheel cover 12 to the spindle case 10 is performed under a state in which the screw 41*a* on a front left side, among the screws 41*a*, 41*b*, 41*c*, 41*d* for attaching the spindle case 10 to the gear housing 8, is not tightened and the other screws 41*b*, 41*c*, 41*d* are tightened. From this state, the ribs 58, 60, 62 and the notches 70, 72, 74 are positioned to meet each other and the wheel cover 12 is slid upward relative to the spindle case 10, as a result of which the wheel cover 12 is attached to the spindle case 10 as shown in FIG. 5. The position of the wheel cover 12 at this occasion is the removable position. After this, as shown in FIG. 6, the wheel cover 12 is rotated counterclockwise as seen from below to rotate the wheel cover 12 from the removable position to the normal position. After this, as shown in FIG. 7, a stopper 78 is attached with the screw 41*a*. The stopper 78 is given a shape which makes contact with a side surface of the wheel cover 12 when the wheel cover 12 rotates from the normal position toward the removable position (the position of the wheel cover 12 shown in FIG. 5) clockwise as seen from below. Due to this, after the stopper 78 has been attached, the wheel cover 12 is prohibited from rotating from the normal position to the removable position. Due to this, the wheel cover 12 is prevented from being removed from the spindle case 10 by the user.

As shown in FIG. 8, the stopper 78 is provided with a sleeve 80 and a cap 82. The sleeve 80 is a bottomed cylindrical member including a bottom surface on its upper side and having its lower side opened. The bottom surface on the upper side of the sleeve 80 has a hole 80*a* for inserting the screw 41*a*. The sleeve 80 is attached to the spindle case 10 by being fastened together with the spindle case 10, through the hole 80*a* in its bottom surface of the upper side, by the screw 41*a* for attaching the spindle case 10 to the gear housing 8. The cap 82 is fitted into the opening on the lower side of the sleeve 80 after the sleeve 80 has been fastened together with the spindle case 10 by the screw 41*a* to shield a head of the screw 41*a* from outside. Due to this, the screw 41*a* can be prevented from being removed by the user, and the stopper 78 can be prevented from being removed from the spindle case 10.

Second Embodiment

A grinder 102 of the present embodiment includes a similar configuration to the grinder 2 of the first embodiment. Hereinbelow, features differing from the grinder 2 of the first embodiment will be exclusively described in detail.

Figure 9:
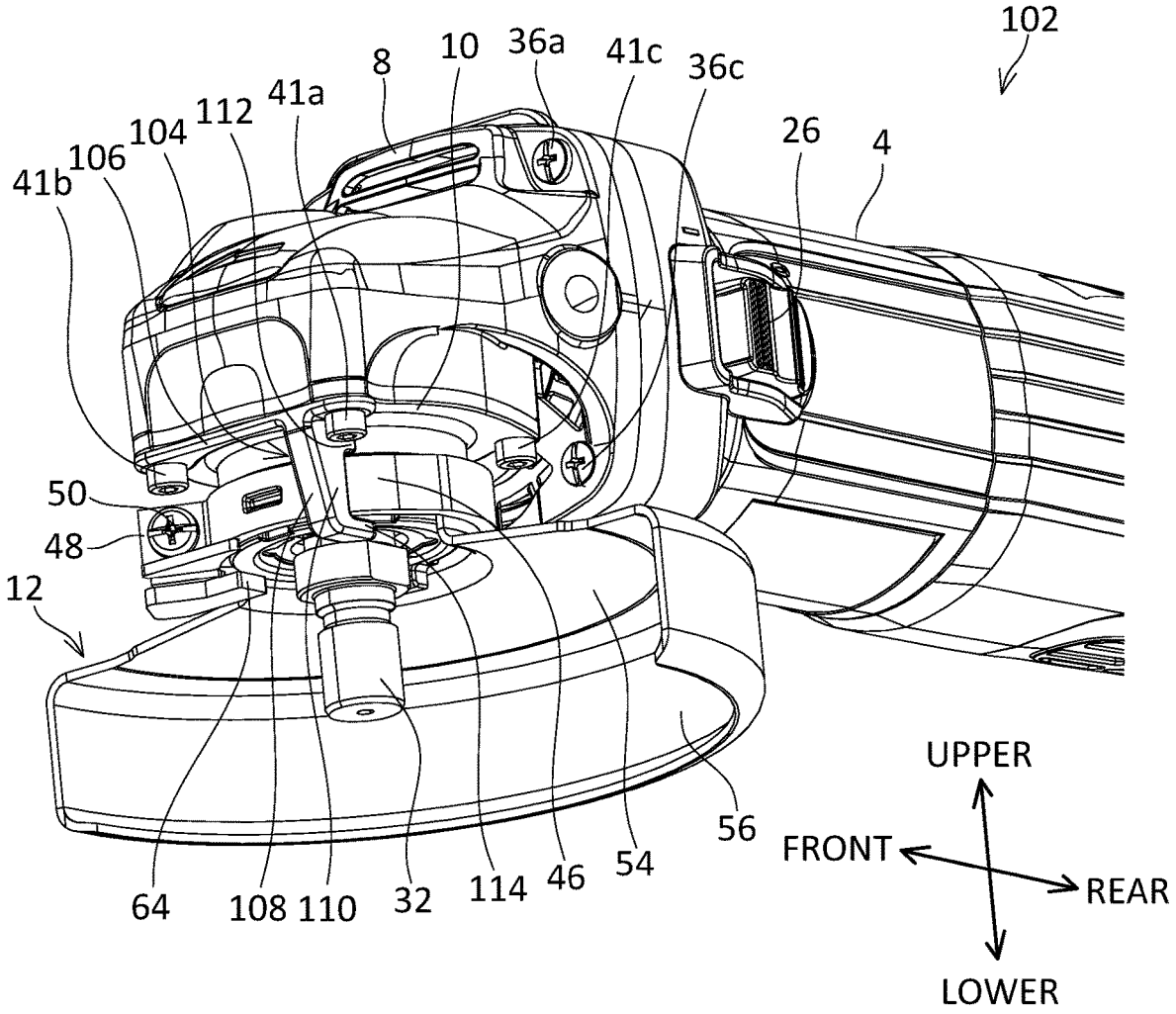
FIG. 9 is a perspective view seeing a grinder 102 of a second embodiment from the lower front left side.
Figure 10:
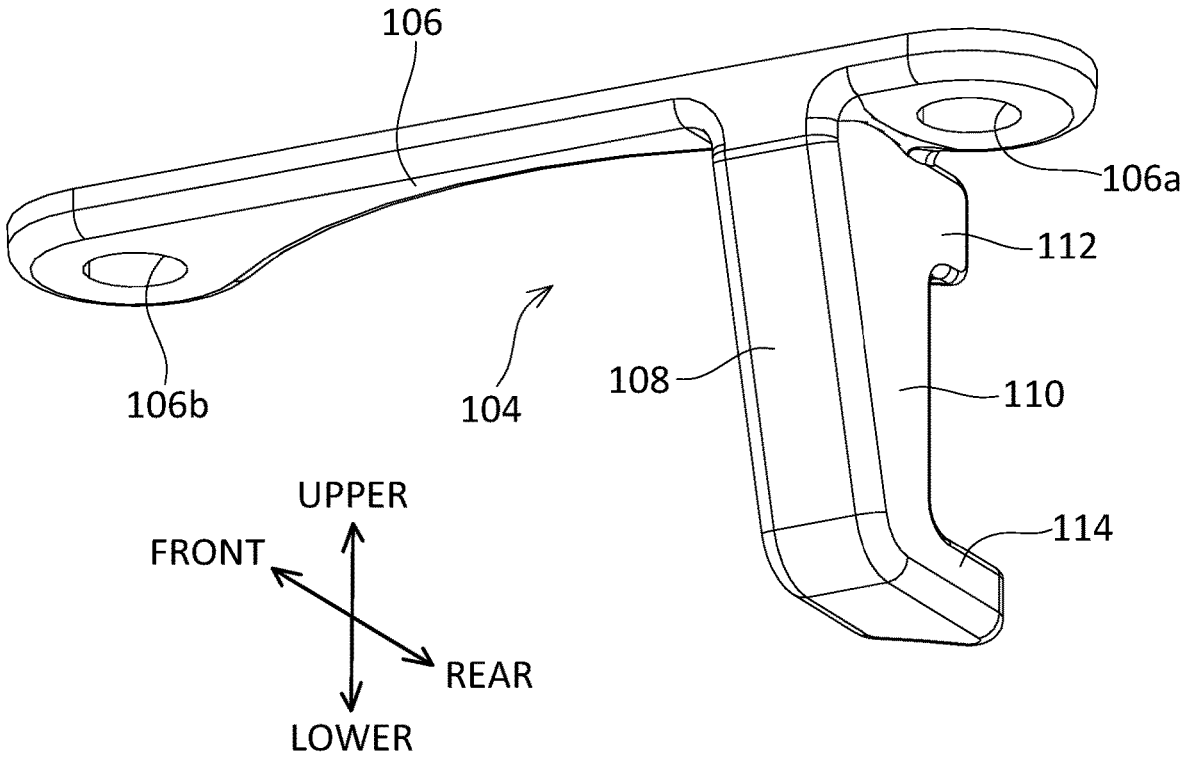
FIG. 10 is a perspective view showing an outer appearance of a stopper 104 of the grinder 102 of the second embodiment.

As shown in FIG. 9, the grinder 102 of the present embodiment is provided with a stopper 104 instead of the stopper 78 of the first embodiment. As shown in FIG. 10, the stopper 104 includes a support 106 and a hook 108 which is formed integrally with the support 106. The support 106 is provided with holes 106*a*, 106*b* for inserting the screws 41*a*, 41*b*. The hook 108 includes a contact portion 110 protruding downward from the support 106, an upper engagement portion 112 protruding rearward from an upper end of the contact portion 110, and a lower engagement portion 114 protruding rearward from a lower end of the contact portion 110. As shown in FIG. 9, the stopper 104 is attached to the spindle case 10 by being fastened together with the spindle case 10, through the holes 106*a*, 106*b* in the support 106, by two screws 41*a*, 41*b* on the front side among the screws 41*a*,

41*b*, 41*c*, 41*d* for attaching the spindle case 10 to the gear housing 8. The contact portion 110 of the hook 108 is given a shape that makes contact with the side surface of the wheel cover 12 when the wheel cover 12 rotates from the normal position toward the removable position. The upper engagement portion 112 of the hook 108 is given a shape that engages with an upper surface of the curved portion 46 of the wheel cover 12. The upper engagement portion 112 constrains an upward motion of the curved portion 46 of the wheel cover 12. The lower engagement portion 114 of the hook 108 is given a shape that engages with a lower surface of the curved portion 46 of the wheel cover 12. The lower engagement portion 114 constrains a downward motion of the curved portion 46 of the wheel cover 12.

Figure 11:
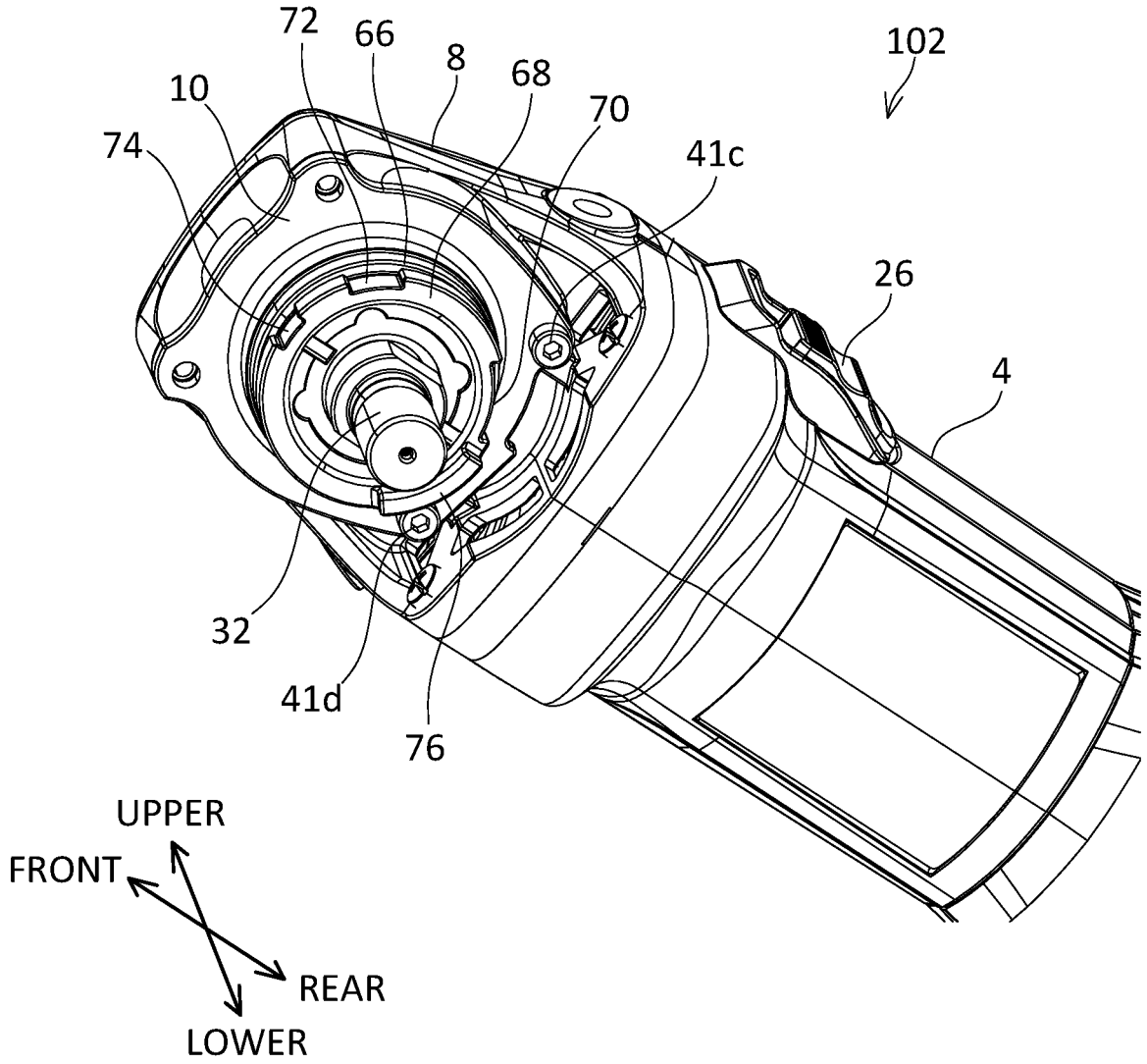
FIG. 11 is a perspective view seeing the grinder 102 of the second embodiment from the lower front left side before the wheel cover 12 and the stopper 104 are attached.
Figure 12:
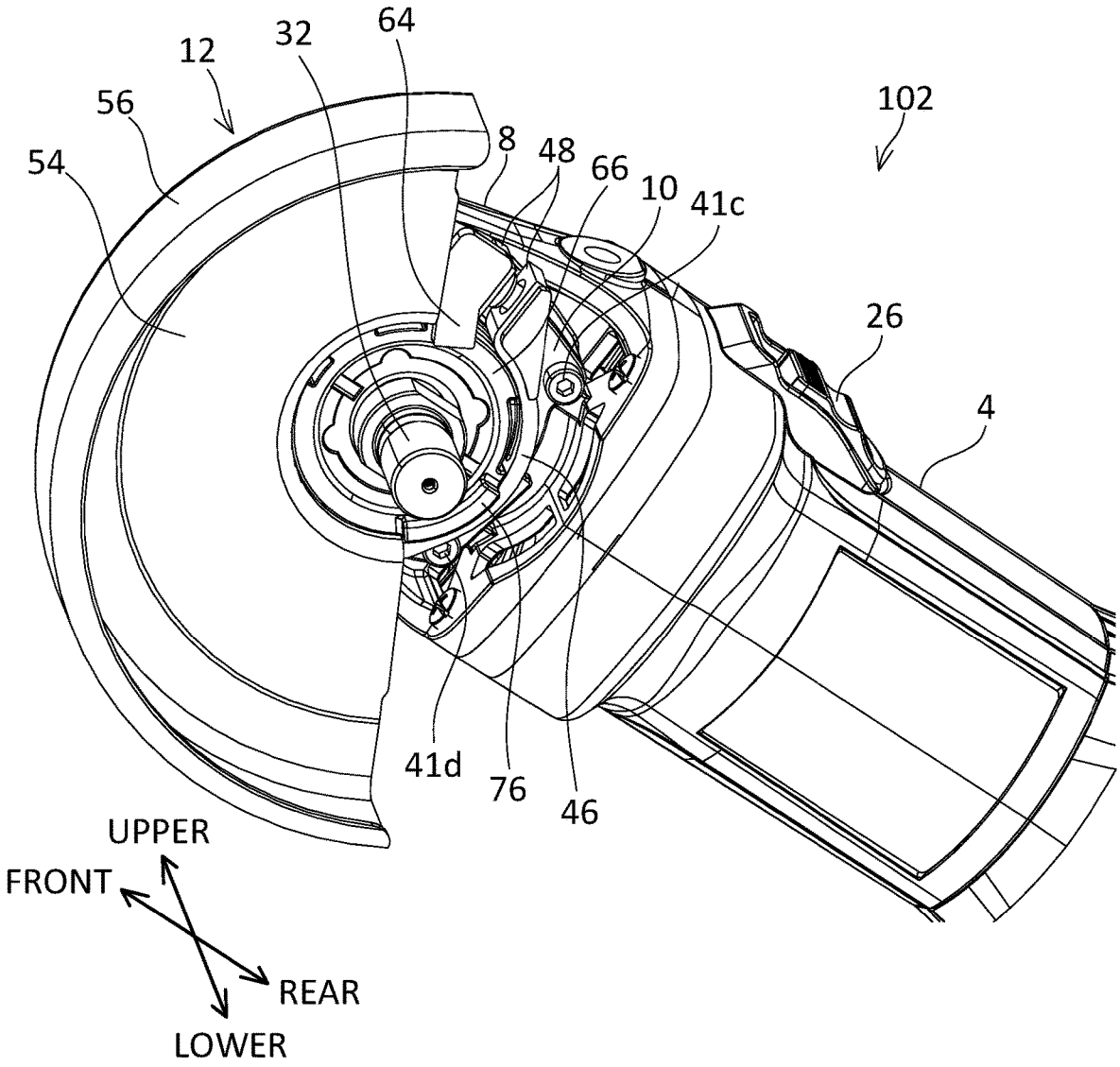
FIG. 12 is a perspective view seeing the grinder 102 of the second embodiment from the lower front left side after the wheel cover 12 has been attached and when the wheel cover 12 is at a removable position.
Figure 13:
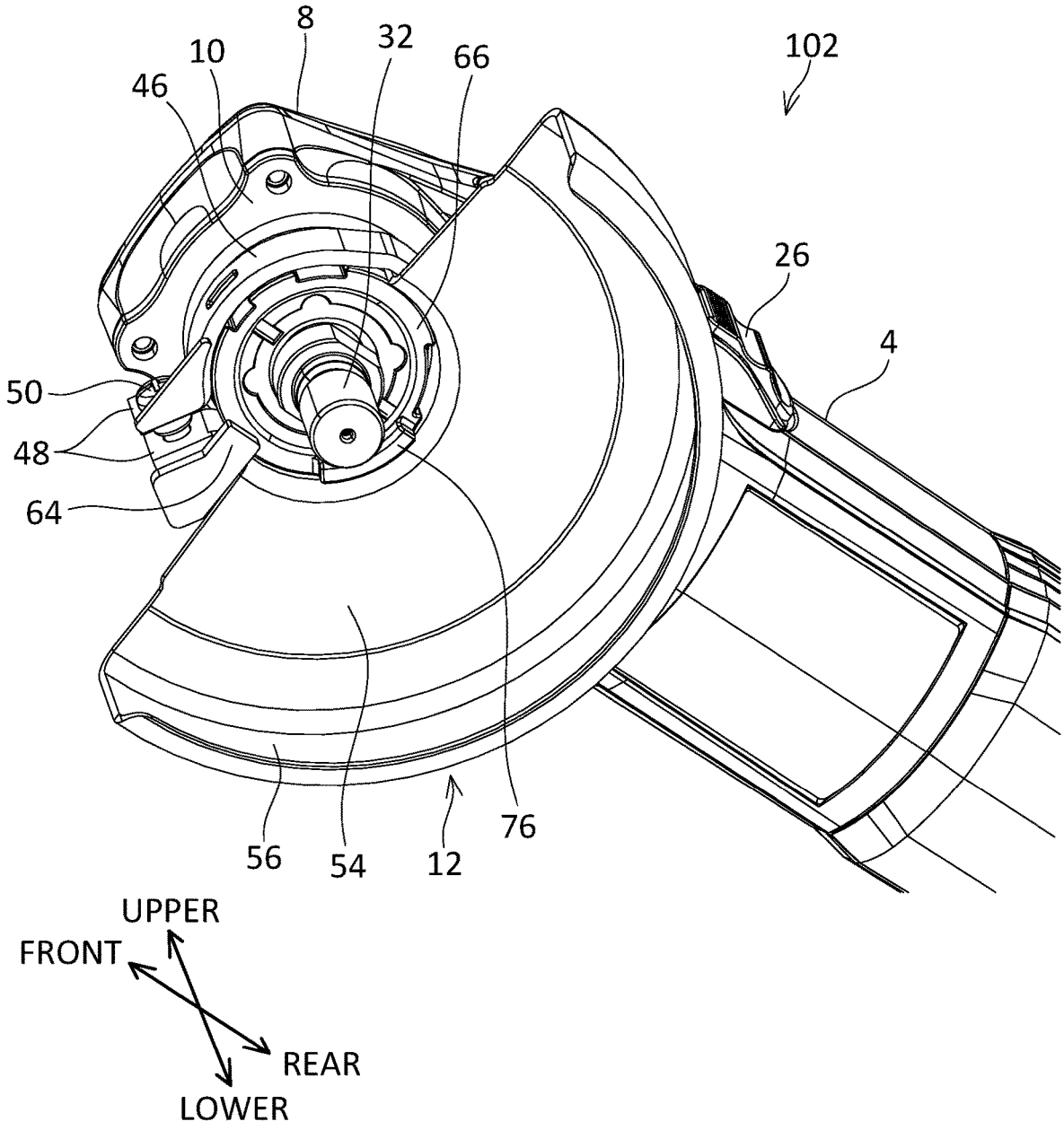
FIG. 13 is a perspective view seeing the grinder 102 of the second embodiment from the lower front left side after the wheel cover 12 has been attached and when the wheel cover 12 is at a normal position.
Figure 14:
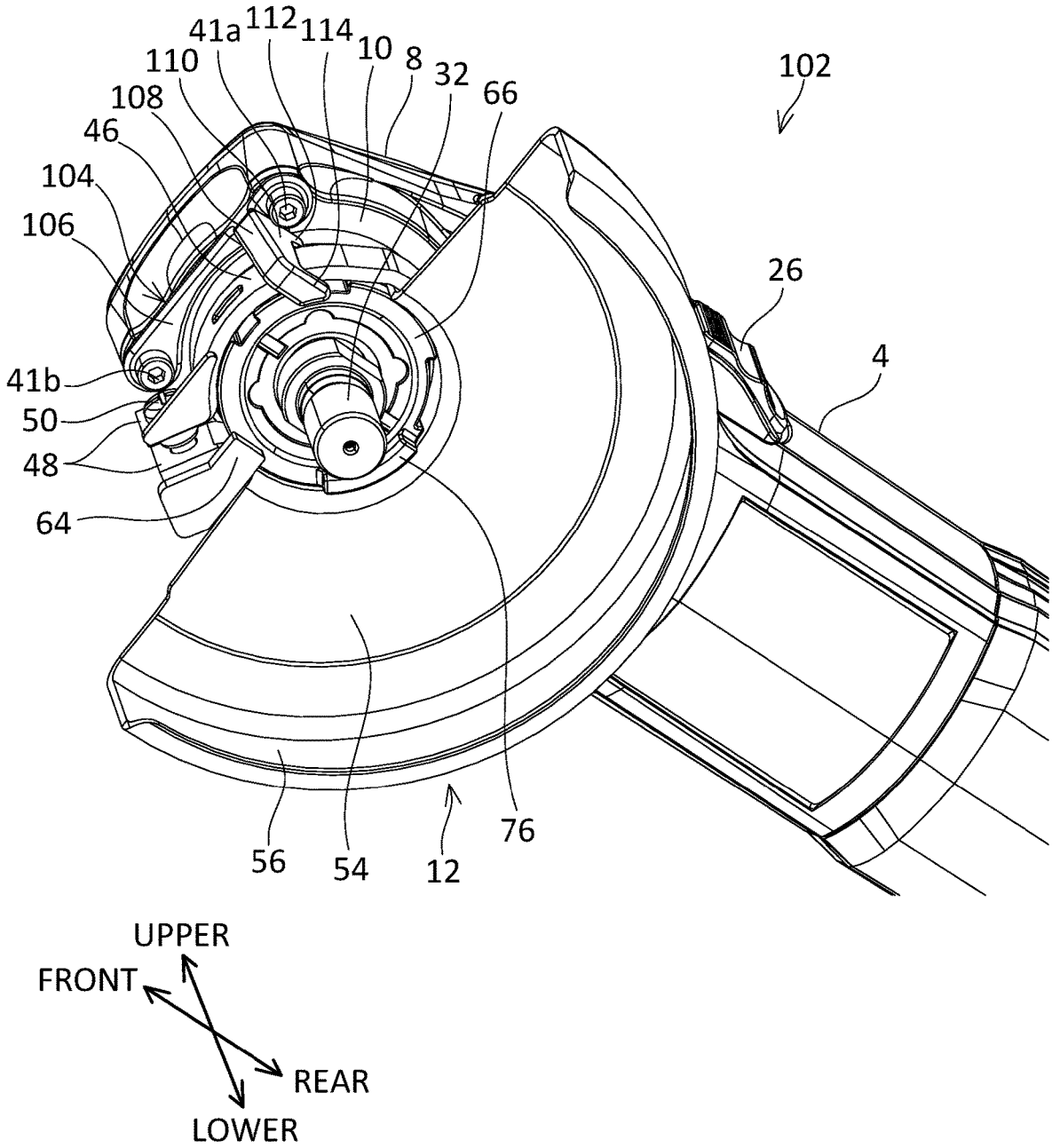
FIG. 14 is a perspective view seeing the grinder 102 of the second embodiment from the lower front left side after the wheel cover 12 has been attached and the stopper 104 has further been attached.

As shown in FIG. 11, in the grinder 102 of the present embodiment, the attachment of the wheel cover 12 to the spindle case 10 is performed under a state in which the two screws 41*a*, 41*b* on the front side, among the screws 41*a*, 41*b*, 41*c*, 41*d* for attaching the spindle case 10 to the gear housing 8, are not tightened and the two screws 41*c*, 41*d* on the rear side are tightened. From this state, the ribs 58, 60, 62 and the notches 70, 72, 74 are positioned to meet each other and the wheel cover 12 is slid upward relative to the spindle case 10, and the wheel cover 12 is thereby attached to the spindle case 10 as shown in FIG. 12. After this, as shown in FIG. 13, the wheel cover 12 is rotated counterclockwise as seen from below to rotate the wheel cover 12 from the removable position to the normal position. After this, as shown in FIG. 14, the stopper 104 is attached with the screws 41*a*, 41*b*. The stopper 104 makes contact with the side surface of the wheel cover 12 when the wheel cover 12 rotates from the normal position toward the removable position (the position of the wheel cover 12 shown in FIG. 12) clockwise as seen from below. Due to this, after the stopper 104 has been attached, the wheel cover 12 is prohibited from rotating from the normal position to the removable position. Due to this, the wheel cover 12 is prevented from being removed from the spindle case 10 by the user.

In the grinder 102 of the present embodiment, one or both of the screws 41*a*, 41*b* for fastening the stopper 104 together with the spindle case 10 may be special screw(s) that cannot be removed by regular tools on the market. By configuring as above, the screw 41*a* and/or the screw 41*b* can be prevented from being removed by the user, and the stopper 104 can also be prevented from being removed from the spindle case 10. As such special screws, for example, screws having a screw head with a hole shape of a hexagram, a triangle, or a Y-shape may be used.

Third Embodiment

A grinder 202 of the present embodiment includes a similar configuration to the grinder 2 of the first embodiment. Hereinbelow, features differing from the grinder 2 of the first embodiment will exclusively be described in detail.

Figure 15:
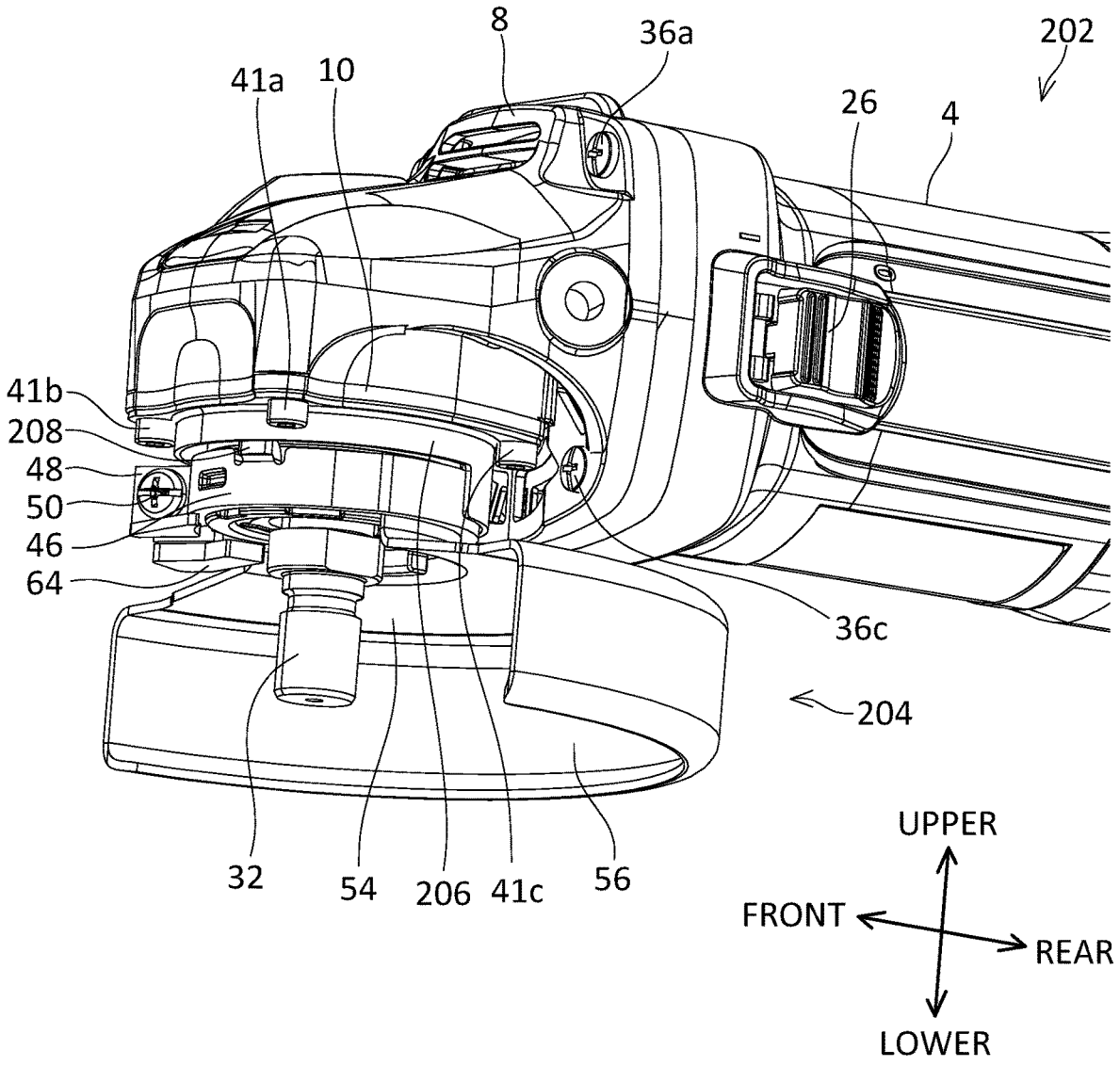
FIG. 15 is a perspective view seeing a grinder 202 of a third embodiment from a front left side.

As shown in FIG. 15, the grinder 202 of the present embodiment is provided with a wheel cover 204 instead of the wheel cover 12 of the first embodiment. Further, the grinder 202 of the present embodiment is provided with a stopper 206 instead of the stopper 78 of the first embodiment.

Figure 16:
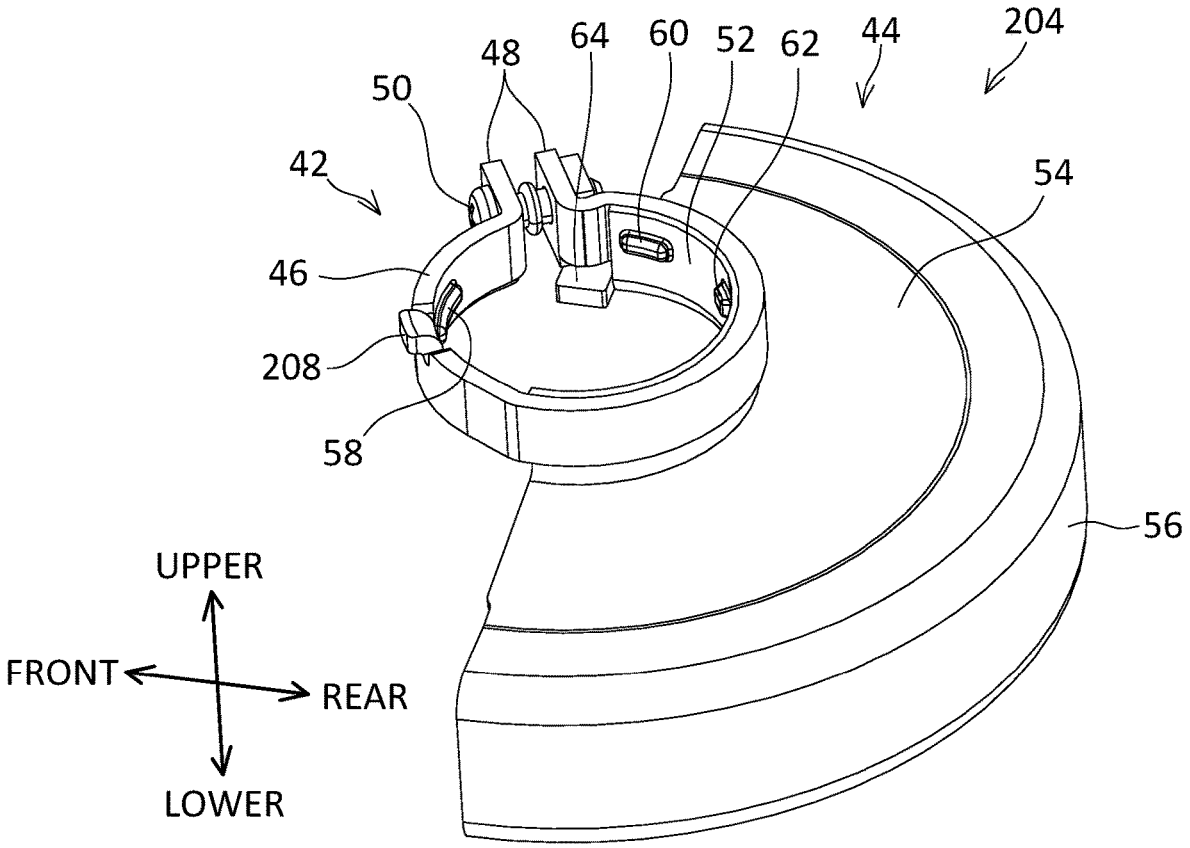
FIG. 16 is a perspective view showing an outer appearance of a wheel cover 204 of the grinder 202 of the third embodiment.

As shown in FIG. 16, the wheel cover 204 is provided with almost the same configuration as the wheel cover 12 of the first embodiment. However, unlike the wheel cover 12 of the first embodiment, the wheel cover 204 of the present embodiment is provided with a protrusion 208 that protrudes outward from an upper end of the curved portion 46. The protrusion 208 is provided at a position that engages with an elastic piece 216 (which will be described later) of the stopper 206 when the wheel cover 204 is at the removable position.

Figure 17:
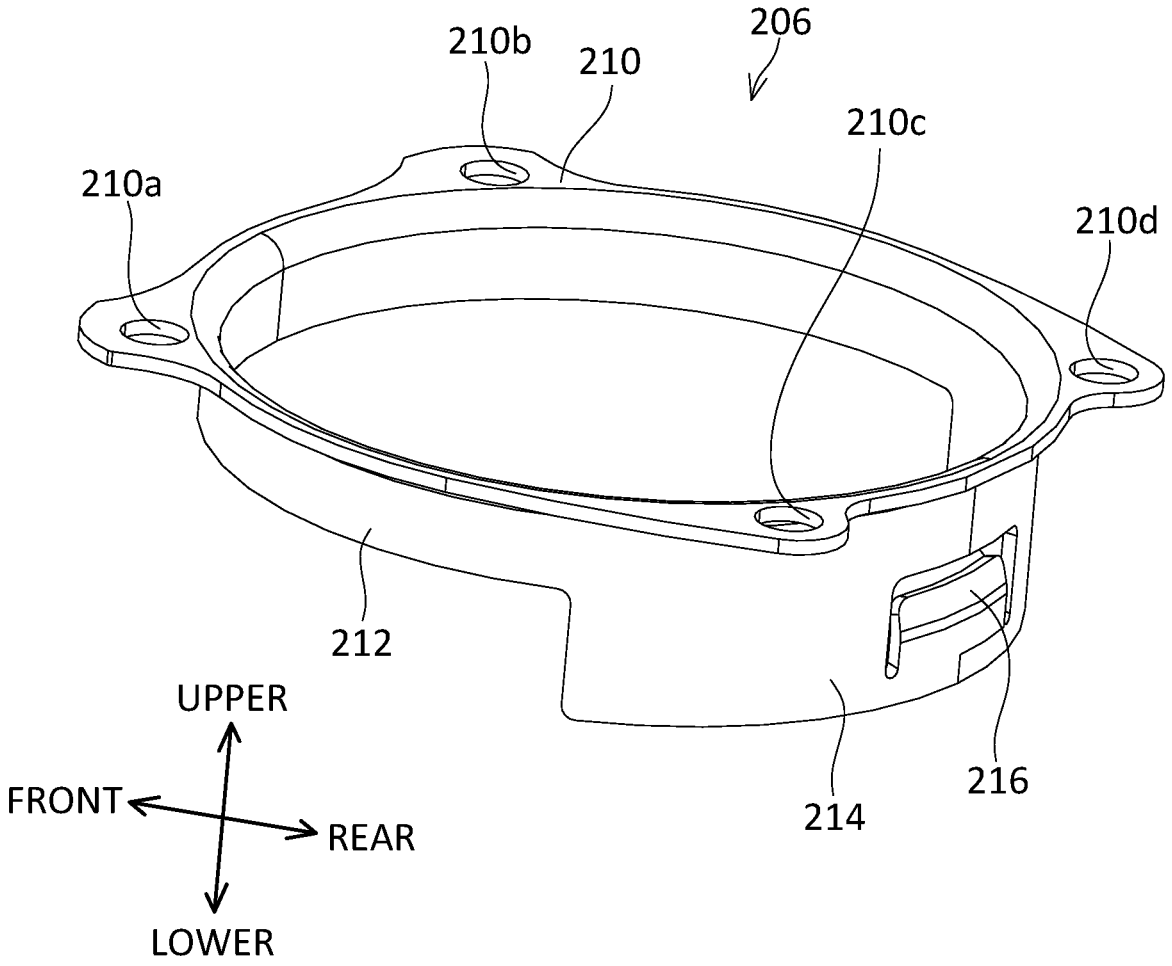
FIG. 17 is a perspective view showing an outer appearance of a stopper 206 of the grinder 202 of the third embodiment.

As shown in FIG. 17, the stopper 206 is provided with a support 210, a cylindrical wall 212 protruding downward from the support 210, and an arched wall 214 protruding downward from a lower end of the cylindrical wall 212. The support 210 is provided with holes 210*a*, 210*b*, 210*c*, 210*d* through which the screws 41*a*, 41*b*, 41*c*, 41*d* are inserted. The cylindrical wall 212 is given a shape which surrounds an outer side of the curved portion 46 of the wheel cover 204. The arched wall 214 is provided with the elastic piece 216 having its upper end protruded inward.

Figure 18:
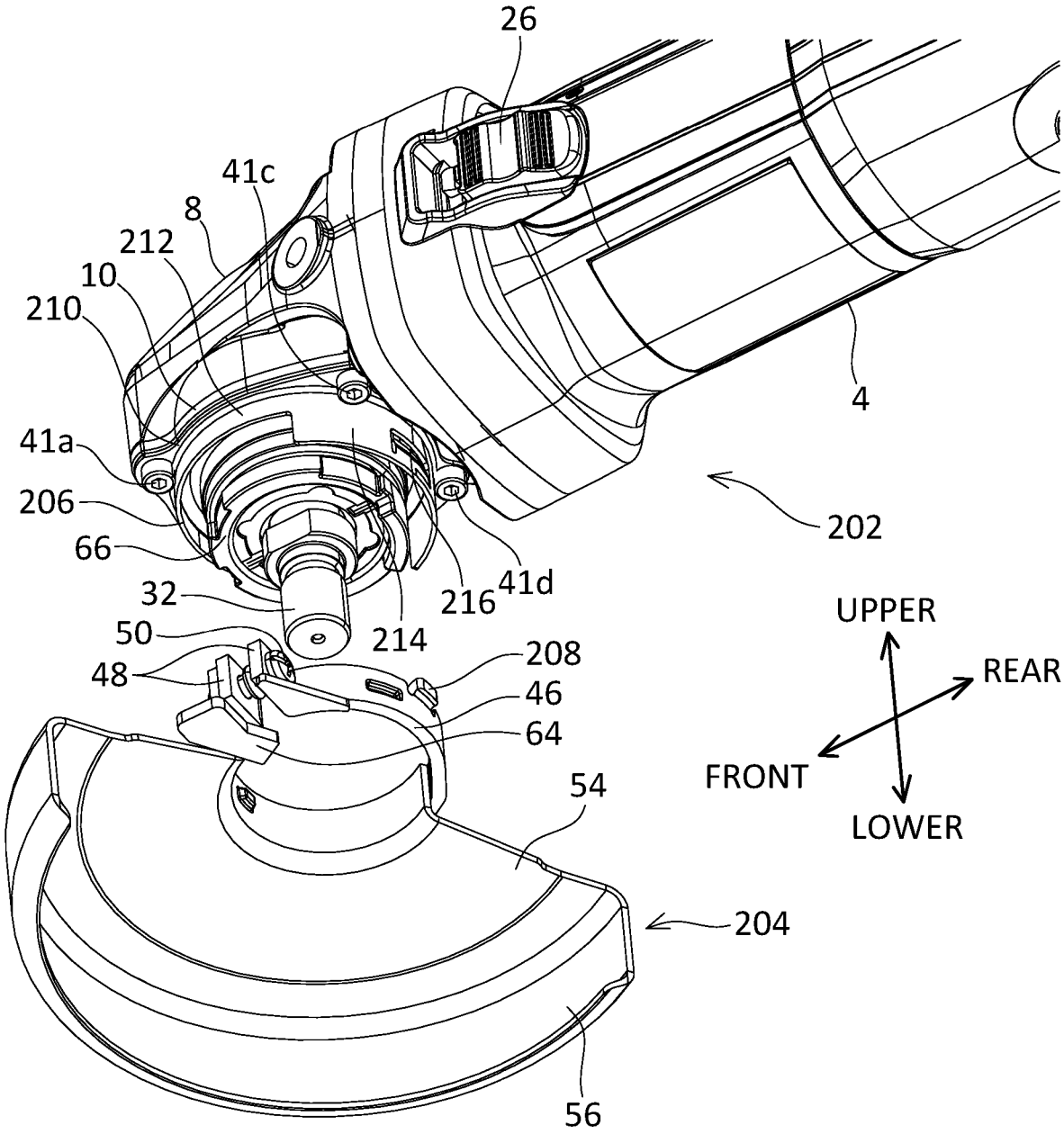
FIG. 18 is a perspective view seeing the grinder 202 of the third embodiment from a lower rear left side before the wheel cover 204 is attached.

As shown in FIG. 18, in the grinder 202 of the present embodiment, the attachment of the stopper 206 to the spindle case 10 is performed prior to the attachment of the wheel cover 204 to the spindle case 10. The stopper 206 is attached to the spindle case 10 by being fastened together with the spindle case 10, through the holes 210*a*, 210*b*, 210*c*, 210*d* of the support 210, by the four screws 41*a*, 41*b*, 41*c*, 41*d* for attaching the spindle case 10 to the gear housing 8. Under a state in which the stopper 206 is attached to the spindle case 10, the arched wall 214 is arranged on the rear side, and the elastic piece 216 is also arranged on the rear side.

Figure 19:
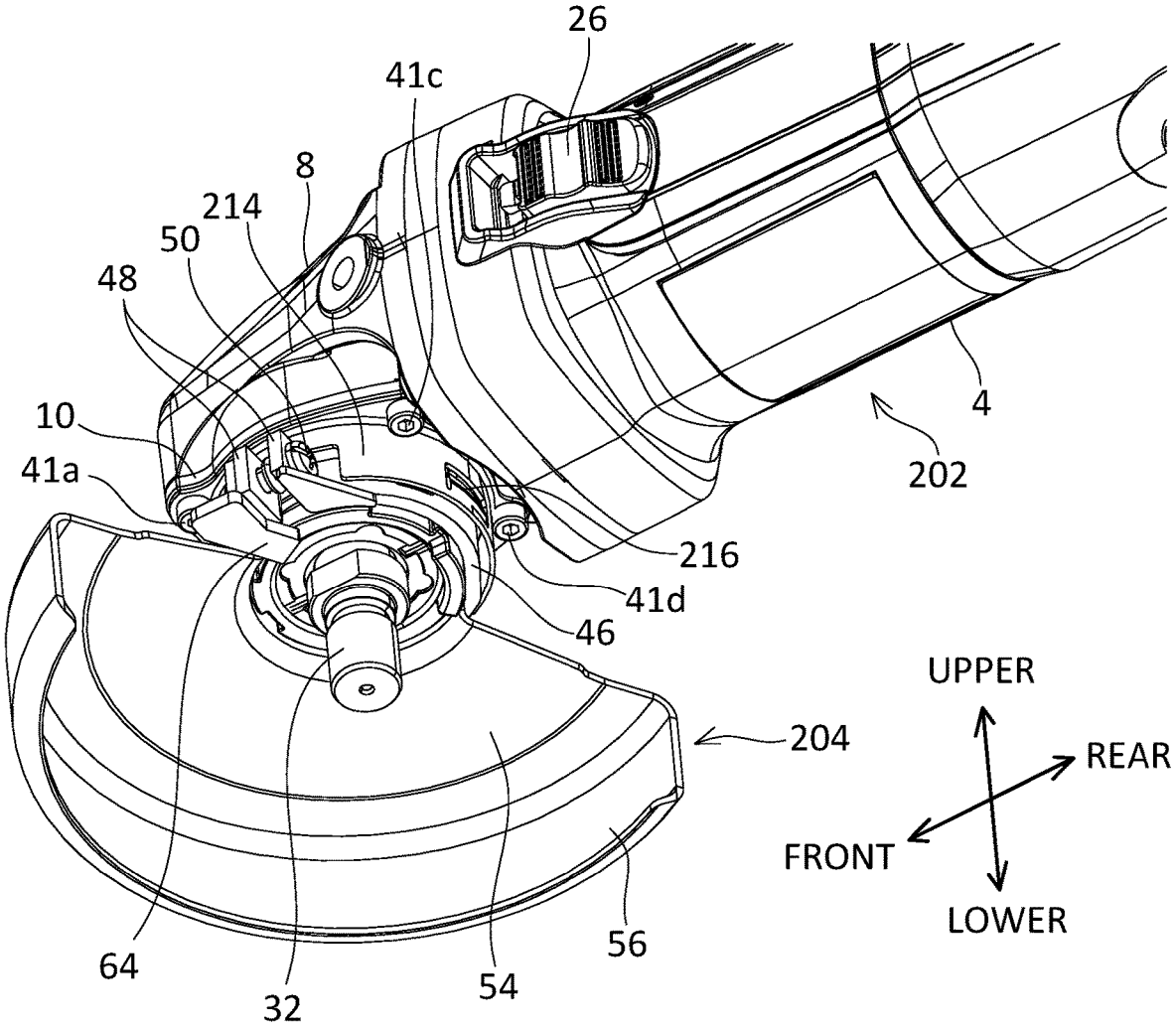
FIG. 19 is a perspective view seeing the grinder 202 of the third embodiment from the lower rear left side after the wheel cover 204 has been attached.

Upon attaching the wheel cover 204 to the spindle case 10, the ribs 58, 60, 62 are positioned to meet the notches 70, 72, 74, and the wheel cover 204 is slid upward relative to the spindle case 10. At this occasion, the protrusion 208 of the wheel cover 204 makes contact with the elastic piece 216 of the stopper 206 from an inner lower side. In this case, the elastic piece 216 is elastically deformed outward, so the wheel cover 204 is allowed to slide upward relative to the spindle case 10. Due to this, as shown in FIG. 19, the wheel cover 204 is attached to the spindle case 10. After this, the wheel cover 204 is rotated from the removable position to the normal position by rotating the wheel cover 204 counterclockwise as seen from below, and the grinder 202 can thereby be used as usual.

With the grinder 202 of the present embodiment, when the wheel cover 204 is attempted to be removed from the spindle case 10 when the wheel cover 204 is at the removable position, the protrusion 208 of the wheel cover 204 makes contact with the elastic piece 216 of the stopper 206 from an inner upper side. In this case, the elastic piece 216 is not elastically deformed outward, and instead the protrusion 208 engages with the elastic piece 216 to prohibit the wheel cover 204 from sliding downward relative to the spindle case 10. Due to this, the wheel cover 204 can be prevented from being removed from the spindle case 10 by the user.

In the grinder 202 of the present embodiment, the elastic piece 216 of the stopper 206 is arranged on the rear side. Due to this, in a case where the wheel cover 204 is at the normal position, the elastic piece 216 is shielded from the grinding wheel GW by the wheel cover 204. Due to this, chips can be prevented from flying onto the elastic piece 216 upon using the grinder 202. Normal rotary motion of the wheel cover 204 can be prevented from being affected by chips adhering to the elastic piece 216.

In the grinder 202 of the present embodiment, at least one of the screws 41*a*, 41*b*, 41*c*, 41*d* for fastening the stopper 206 together with the spindle case 10 may be special screws that cannot be removed by regular tools on the market. By configuring as above, the at least one of the screws 41*a*, 41*b*, 41*c*, 41*d* can be prevented from being removed by the user, and the stopper 206 can also be prevented from being removed from the spindle case 10.

Fourth Embodiment

A grinder 302 of the present embodiment includes a similar configuration to the grinder 2 of the first embodiment. Hereinbelow, features differing from the grinder 2 of the first embodiment will be exclusively described in detail.

Figure 20:
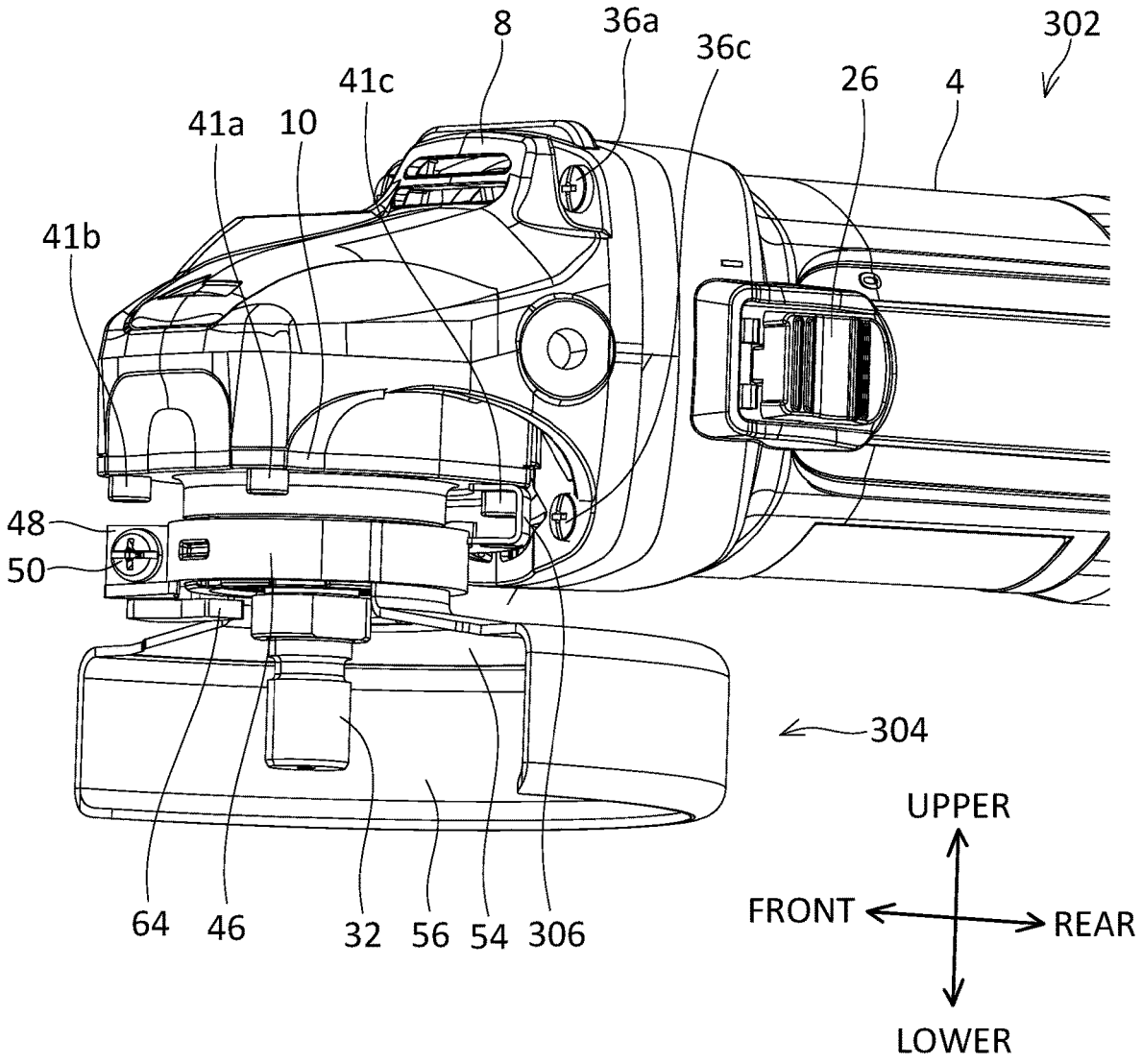
FIG. 20 is a perspective view seeing a grinder 302 of a fourth embodiment from a front left side.

As shown in FIG. 20, the grinder 302 of the present embodiment is provided with a wheel cover 304 instead of the wheel cover 12 of the first embodiment. Further, the grinder 302 of the present embodiment is provided with a stopper 306 instead of the stopper 78 of the first embodiment.

Figure 21:
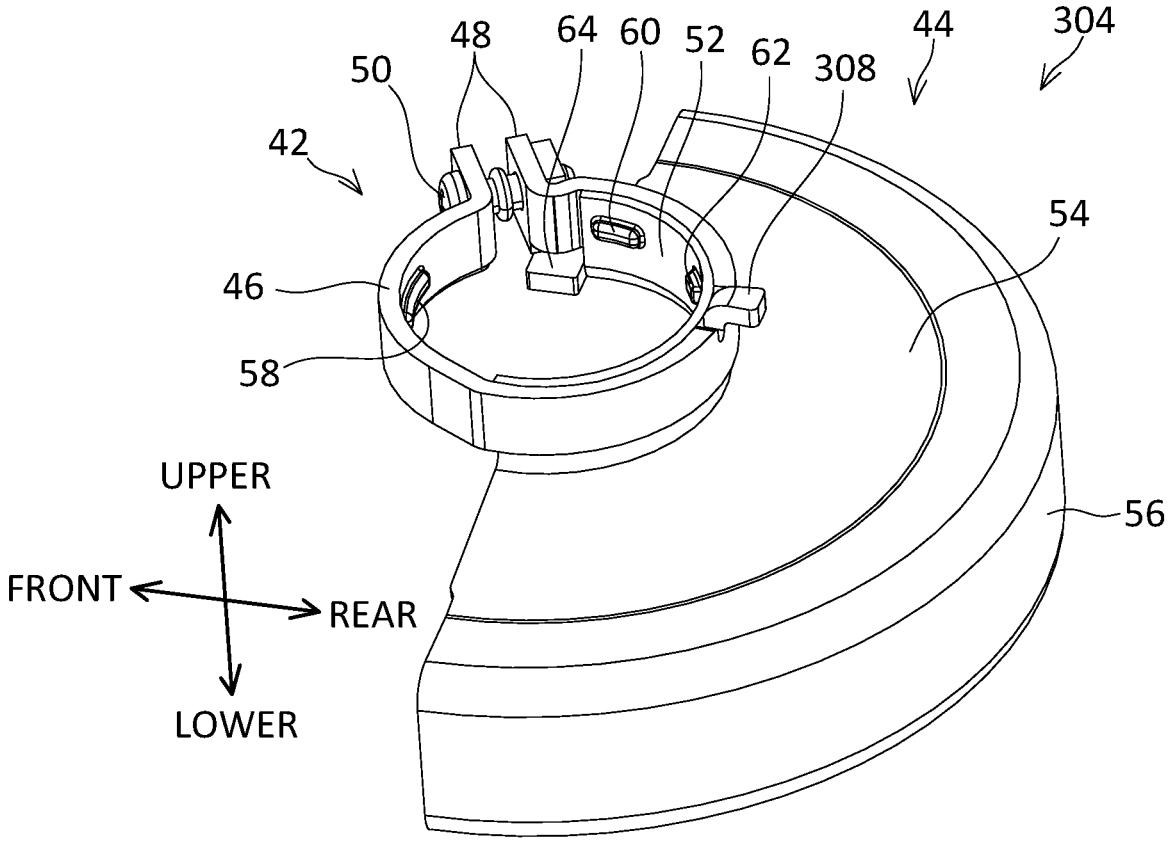
FIG. 21 is a perspective view showing an outer appearance of a wheel cover 304 of the grinder 302 of the fourth embodiment.

As shown in FIG. 21, the wheel cover 304 is provided with almost the same configuration as the wheel cover 12 of the first embodiment. However, unlike the wheel cover 12 of the first embodiment, the wheel cover 304 of the present embodiment is provided with a protrusion 308 that protrudes outward from the upper end of the curved portion 46. The protrusion 308 is provided at a position that makes contact with an elastic piece 316 (which will be described later) of the stopper 306 when the wheel cover 304 is rotated from the normal position to the removable position.

Figure 22:
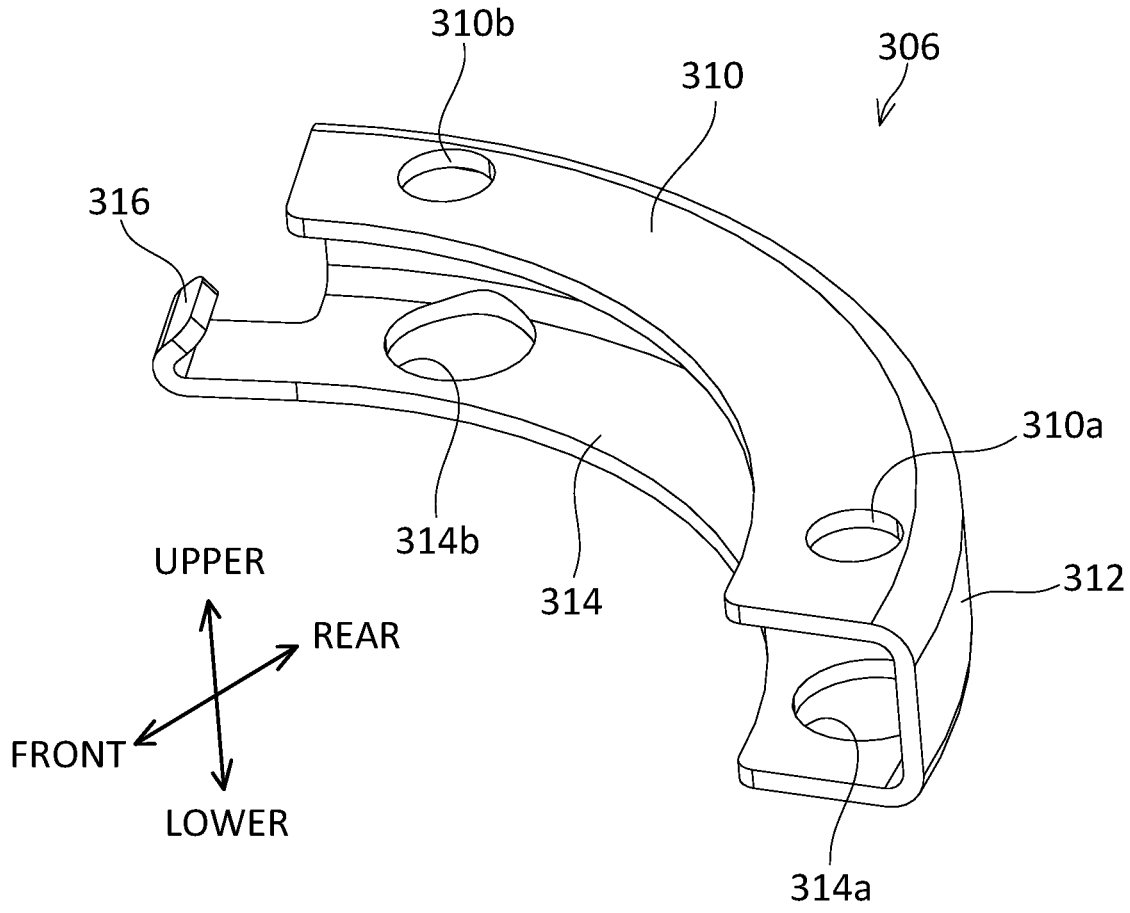
FIG. 22 is a perspective view showing an outer appearance of a stopper 306 of the grinder 302 of the fourth embodiment.

As shown in FIG. 22, the stopper 306 is provided with a support 310, an arched wall 312 protruding downward from the support 310, and a guide portion 314 protruding inward from the arched wall 312. The elastic piece 316 having its tip protruded upward is provided at one end of the guide portion 314. The support 310 is provided with holes 310*a*, 310*b* through which the screws 41*c*, 41*d* are inserted. The guide portion 314 is provided with holes 314*a*, 314*b* for inserting a tool upon fastening the stopper 306 and the spindle case 10 together by the screws 41*c*, 41*d* through the holes 310*a*, 310*b* of the support 310.

Figure 23:
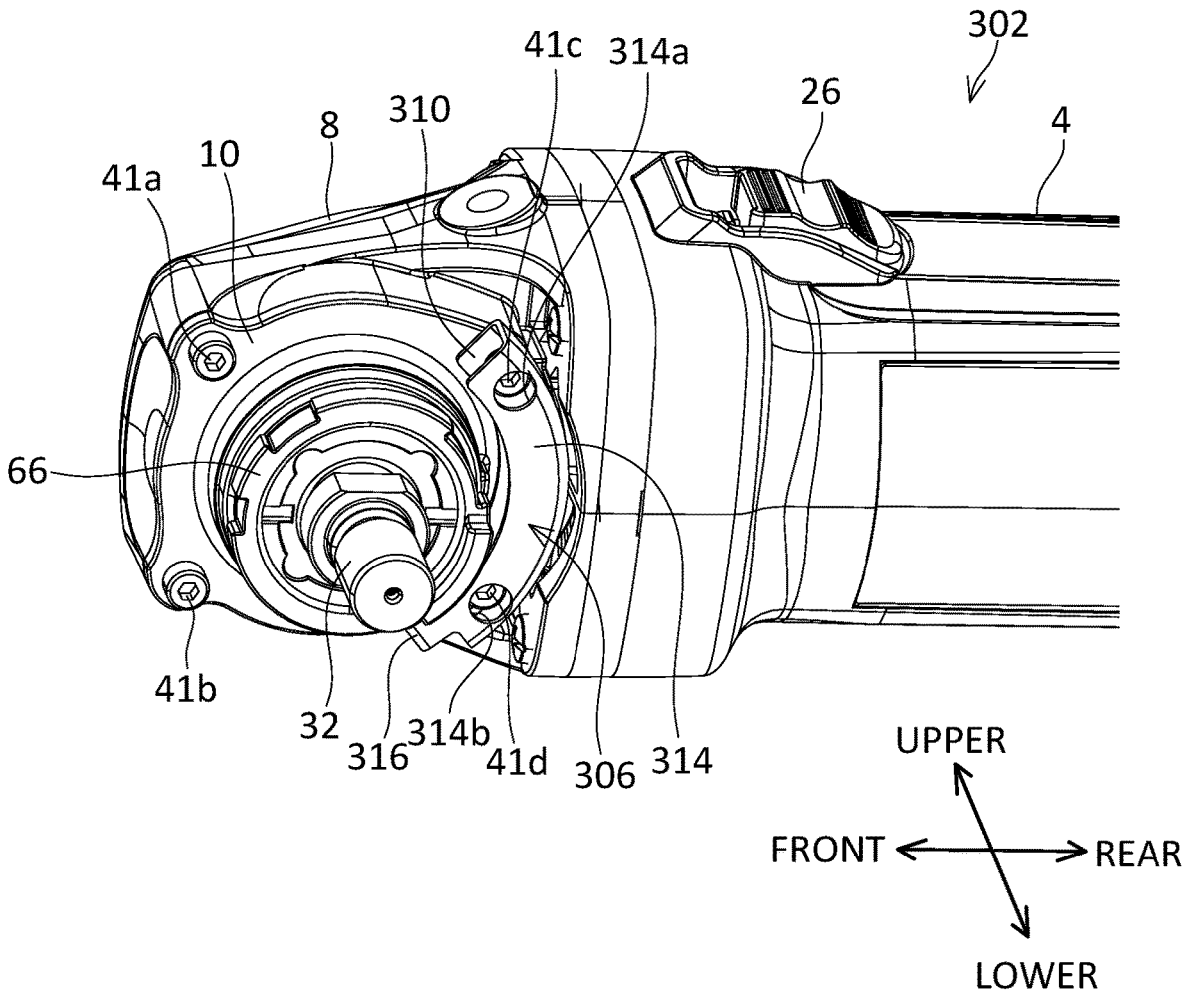
FIG. 23 is a perspective view seeing the grinder 302 of the fourth embodiment from the lower front left side before the wheel cover 304 is attached.

As shown in FIG. 23, in the grinder 302 of the present embodiment, the attachment of the stopper 306 to the spindle case 10 is performed prior to the attachment of the wheel cover 304 to the spindle case 10. The stopper 306 is attached to the spindle case 10 by being fastened together with the spindle case 10, through the holes 310*a*, 310*b* of the support 310, by the two screws 41*c*, 41*d* on the rear side among the screws 41*a*, 41*b*, 41*c*, 41*d* for attaching the spindle case 10 to the gear housing 8. Under a state in which the stopper 306 is attached to the spindle case 10, the stopper 306 is arranged on the rear side, and the elastic piece 316 is also arranged on the rear side.

Figure 24:
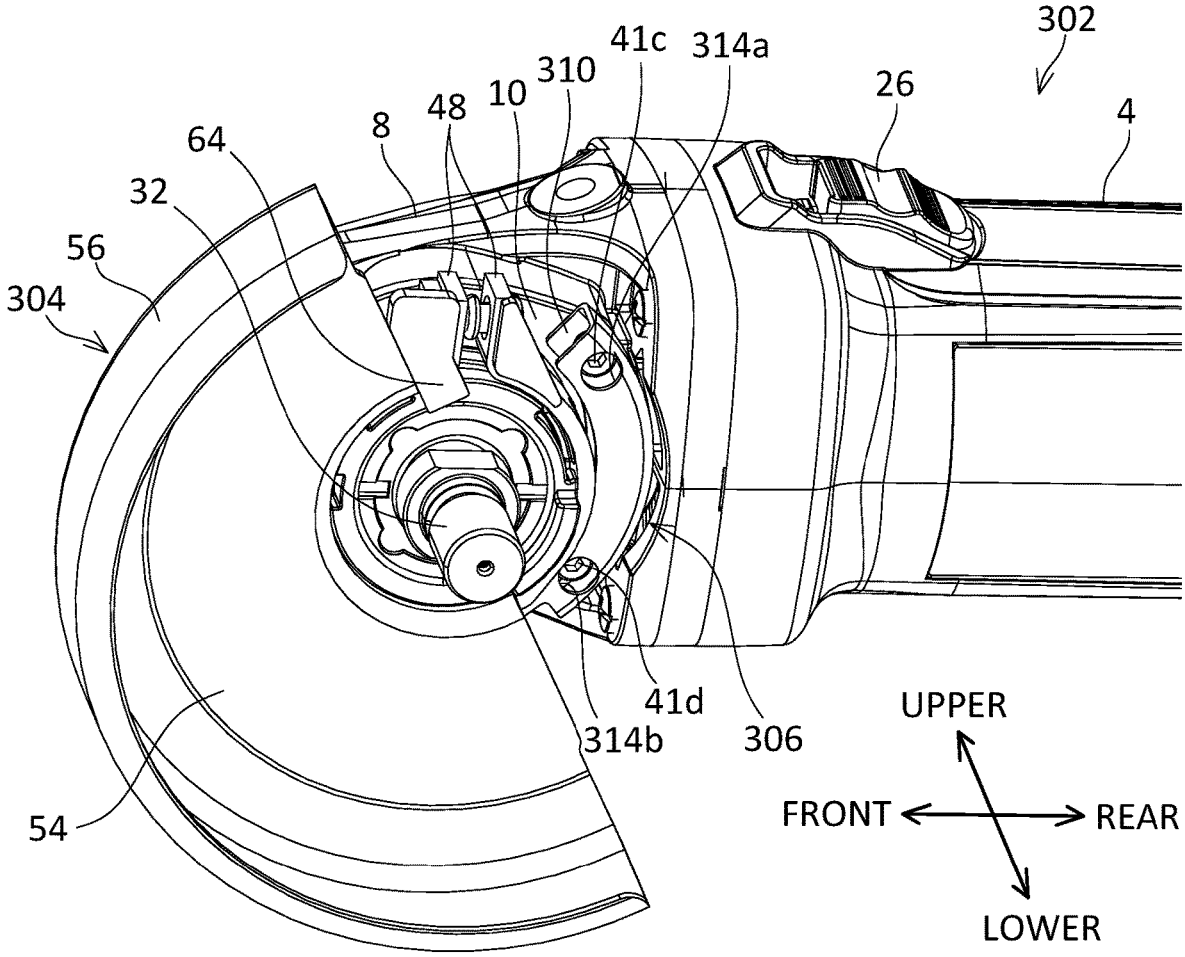
FIG. 24 is a perspective view seeing the grinder 302 of the fourth embodiment from the lower front left side after the wheel cover 304 has been attached and when the wheel cover 304 is at a removable position.
Figure 25:
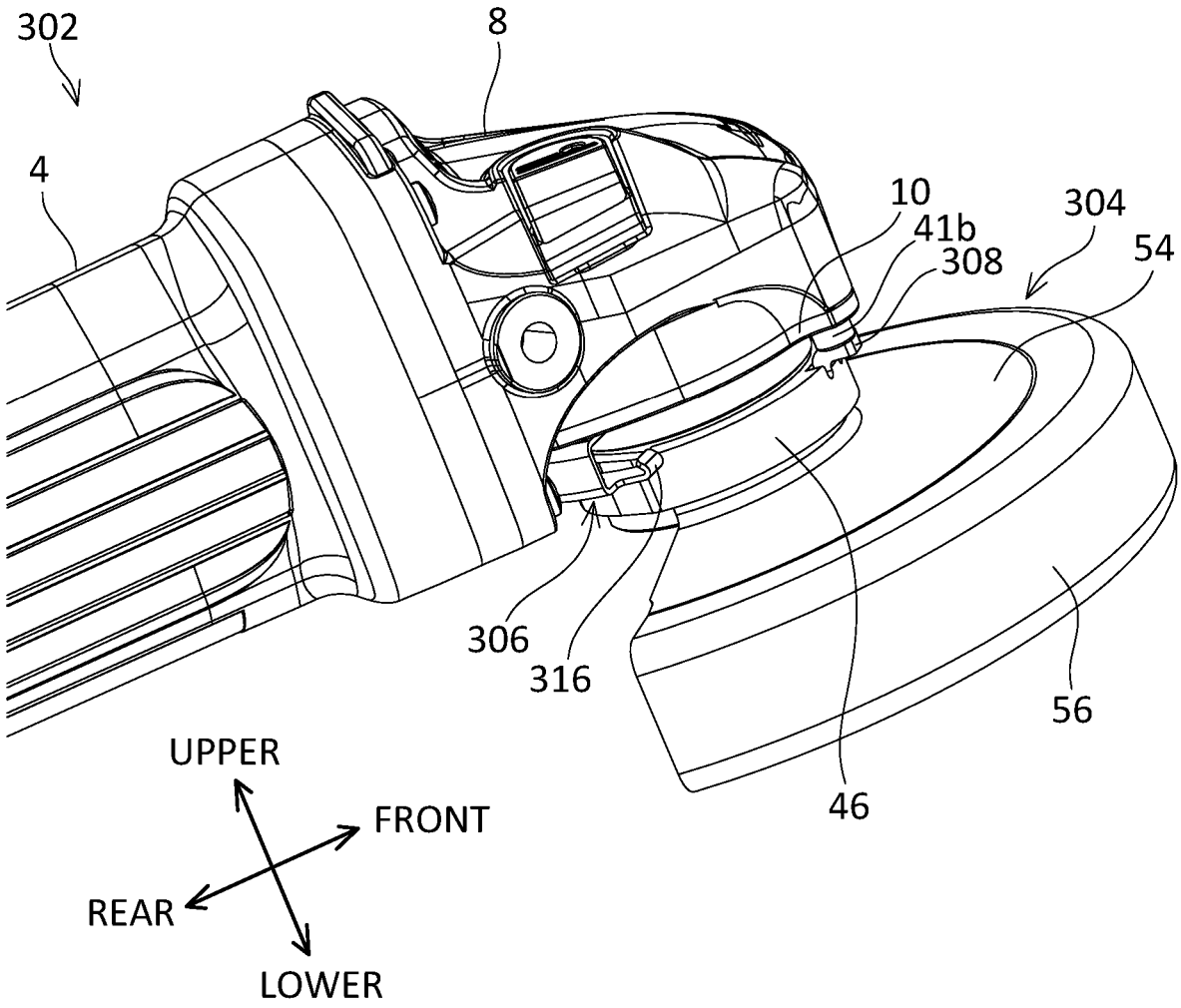
FIG. 25 is a perspective view seeing the grinder 302 of the fourth embodiment from a rear right side after the wheel cover 304 has been attached and when the wheel cover 304 is at the removable position.
Figure 26:
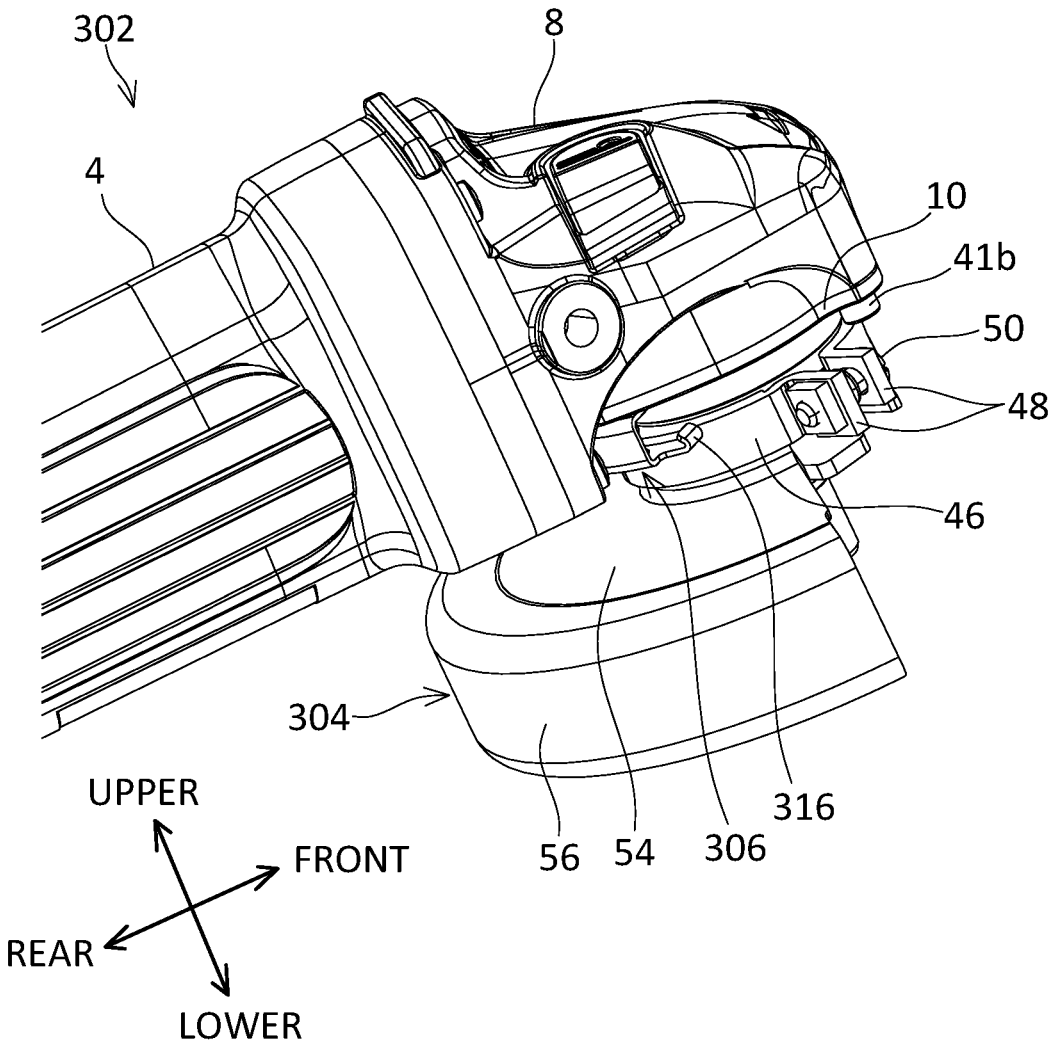
FIG. 26 is a perspective view seeing the grinder 302 of the fourth embodiment from the rear right side after the wheel cover 304 has been attached and when the wheel cover 304 is at a normal position.

Upon attaching the wheel cover 304 to the spindle case 10, the ribs 58, 60, 62 are positioned to meet the notches 70, 72, 74 and the wheel cover 304 is slid upward relative to the spindle case 10, and the wheel cover 304 is thereby attached to the spindle case 10 as shown in FIG. 24. At this occasion, as shown in FIG. 25, the protrusion 308 of the wheel cover 304 is arranged outside the stopper 306. When the wheel cover 304 is rotated counterclockwise as seen from below to rotate it from the removable position to the normal position, the protrusion 308 of the wheel cover 304 makes contact with the elastic piece 316 of the stopper 306 from an upper outer side. In this case, the elastic piece 316 is elastically deformed downward, so the wheel cover 304 is allowed to rotate relative to the spindle case 10. By configuring as above, as shown in FIG. 26, the protrusion 308 of the wheel cover 304 enters to an inner side of the stopper 306 and the wheel cover 304 rotates to the normal position.

Figure 27:
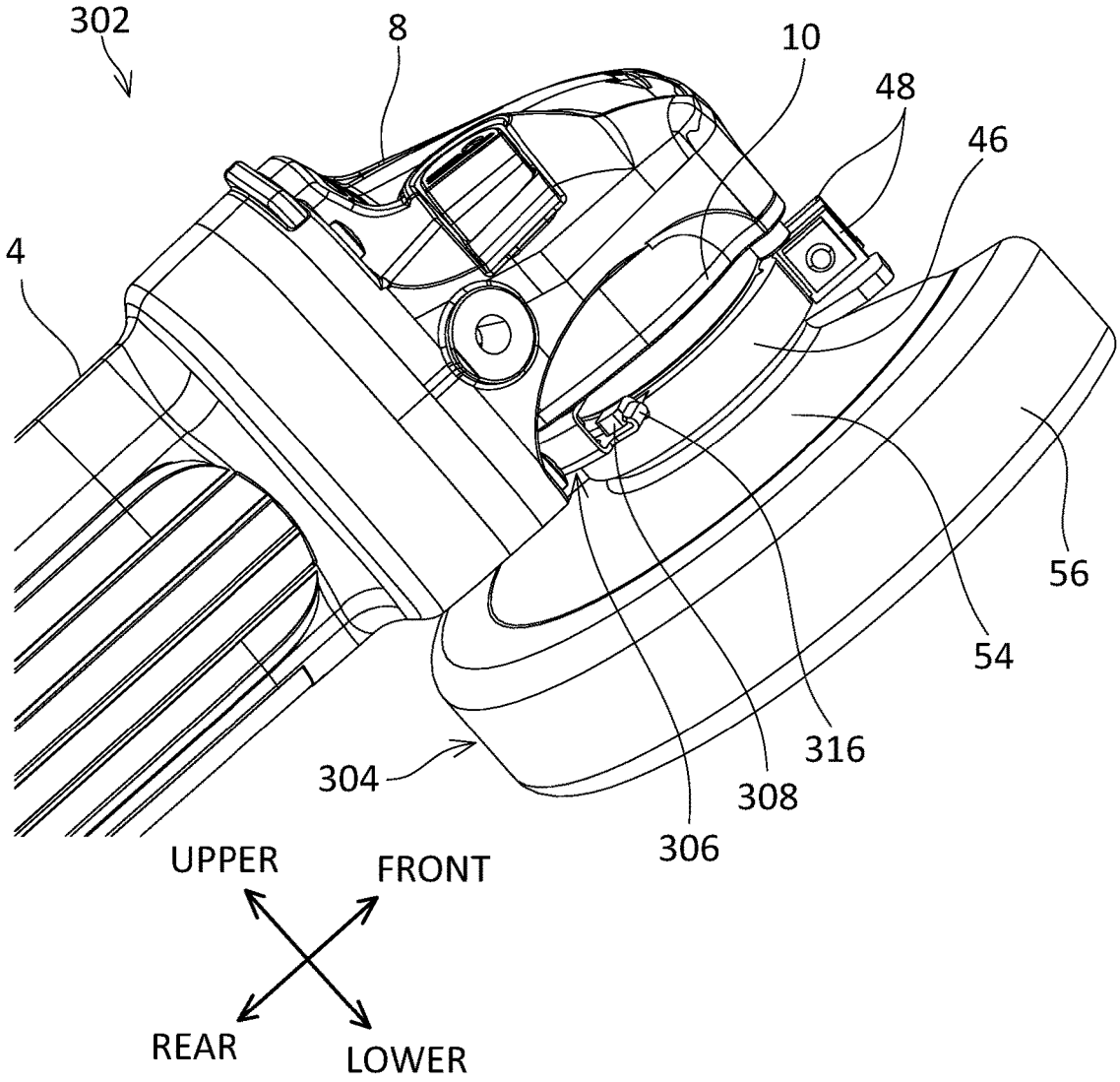
FIG. 27 is a perspective view seeing the grinder 302 of the fourth embodiment from the rear right side after the wheel cover 304 has been attached and when the wheel cover 304 is engaged with the stopper 306.

When the wheel cover 304 is rotated from the normal position toward the removable position by rotating it clockwise as seen from below, the protrusion 308 of the wheel cover 304 makes contact with the elastic piece 316 of the stopper 306 from an upper inner side as shown in FIG. 27. In this case, the elastic piece 316 is not elastically deformed downward, and instead the protrusion 308 engages with the elastic piece 316 to prohibit the wheel cover 304 from rotating relative to the spindle case 10. Due to this, the wheel cover 304 can be prevented from being removed from the spindle case 10 by the user.

In the grinder 302 of the present embodiment, the stopper 306 is arranged on the rear side. Due to this, in a case where the wheel cover 304 is in the normal position, the stopper 306 is shielded from the grinding wheel GW by the wheel cover 304. Due to this, chips can be prevented from flying onto the stopper 306 upon using the grinder 302. Normal rotary motion of the wheel cover 304 can be prevented from being affected by chips adhering to the stopper 306.

In the grinder 302 of the present embodiment, the stopper 306 is fastened together with the spindle case 10 by the two screws 41*c*, 41*d* on the rear side among the four screws 41*a*, 41*b*, 41*c*, 41*d* for attaching the spindle case 10 to the gear housing 8. Due to this, in a case where the wheel cover 304 is at the normal position, the screws 41*c*, 41*d* fastening the stopper 306 together with the spindle case 10 are covered by the wheel cover 304. Due to this, the screws 41*c*, 41*d* can be prevented from being removed by the user, and the stopper 306 can also be prevented from being removed from the spindle case 10.

In the grinder 302 of the present embodiment, one or both of the screws 41*c*, 41*d* for fastening the topper 306 together with the spindle case 10 may be special screw(s) that cannot be removed by regular tools on the market. By configuring as above, the screw 41*c* and/or the screw 41*d* can be prevented from being removed by the user, and the stopper 306 can also be prevented from being removed from the spindle case 10.

In the above embodiments, as the configurations of the wheel covers 12, 204, 304, a configuration that fixes the position of the wheel cover relative to the spindle case 10 by tightening the adjustment screw 50 and releases the fixation of the position relative to the spindle case 10 by loosening the adjustment screw 50 was described. However, unlike the above, the wheel covers 12, 204, 304 may be configured to fix and release their position relative to the spindle case 10 by a lever operation, for example. Alternatively, both of the wheel covers 12, 204, 304 and the spindle case 10 may be provided with latch mechanisms that engage with each other at a predetermined interval, and the position of the wheel cover relative to the spindle case 10 may be fixed and released by engagement and disengagement of the latch mechanisms.

What is claimed is:

1. A grinder comprising:

a motor;

a spindle to which a grinding wheel is attached;

bevel gears configured to transmit rotation of the motor to the spindle;

a motor housing which houses the motor; a gear housing attached to a front side of the motor housing and housing the bevel gears;

a spindle case attached to a lower side of the gear housing and rotatably supporting the spindle;

a wheel cover attached to the spindle case and covering an outside of at least a part of the grinding wheel; and a stopper configured to prohibit removal of the wheel cover, wherein the stopper is attached to the spindle case by a screw which fastens the spindle case to the gear housing, and the stopper, the spindle case and the wheel cover are configured such that the stopper can be attached to the spindle case after the wheel cover is attached to the spindle case;

wherein the wheel cover is rotatable around a rotation axis of the spindle relative to the spindle case, and is removable by being slid along the rotation axis of the spindle at a removable position, and the stopper prohibits the wheel cover from rotating from a normal position to the removable position;

wherein the stopper has a shape that contacts a side surface of the wheel cover when the wheel cover rotates from the normal position to the removable position, and the stopper and the screw are farther from the motor than the spindle in a direction in which an output shaft of the motor extends;

wherein the stopper is attached to the spindle case by an additional screw which fastens the spindle case to the gear housing, wherein the additional screw is farther from the motor than the spindle in the direction in which the output shaft of the motor extends, and when the grinder is seen along the rotation axis of the spindle, a contact position at which the stopper contacts the side surface of the wheel cover is between the screw and the additional screw.

2. The grinder according to claim 1, wherein the stopper includes a hook which is engaged with the wheel cover so as to prohibit the wheel cover from being slid along the rotation axis of the spindle, and contacts the side surface of the wheel cover when the wheel cover rotates from the normal position to the removal position.

3. The grinder according to claim 2, wherein the screw fastening the stopper together with the spindle case is a screw having a screw head with a hole shape of a hexagram, a triangle, or a Y-shape.

* * * * *